United States Patent [19]

Lindbergh

[11] 4,303,117

[45] Dec. 1, 1981

[54] VERTICALLY COLLAPSING CLOSURE SYSTEM

[76] Inventor: Charles Lindbergh, 10 S. Basilica, Charleston, S.C. 29406

[21] Appl. No.: 89,944

[22] Filed: Oct. 31, 1979

[51] Int. Cl.[3] ..... E05D 15/26; E05F 1/04; E05F 11/06

[52] U.S. Cl. ..... 160/189; 49/126; 160/207

[58] Field of Search ..... 160/189, 190, 207, 152; 49/126

[56] References Cited

U.S. PATENT DOCUMENTS

| | | | |
|---|---|---|---|
| 325,168 | 8/1885 | Gornall . | |
| 736,234 | 8/1903 | Delp . | |
| 815,594 | 3/1906 | Kovacevic . | |
| 947,585 | 1/1910 | Ashton . | |
| 1,070,167 | 8/1913 | Nitschke . | |
| 1,073,700 | 9/1913 | Neenan . | |
| 1,750,042 | 3/1930 | Hoover | 160/190 |
| 1,801,220 | 4/1931 | Brown | 160/207 X |
| 1,898,711 | 2/1933 | Borgen . | |
| 1,962,913 | 6/1934 | Rutledge | 160/207 X |
| 1,994,142 | 3/1935 | Madsen | 160/190 |
| 2,020,544 | 11/1935 | Gill et al. | 160/207 X |
| 2,423,987 | 7/1947 | Levikow | 160/207 X |
| 2,604,303 | 7/1952 | Grady | 254/148 X |
| 2,671,638 | 3/1954 | Allen | 254/148 X |
| 3,738,413 | 6/1973 | Frobosilo et al. | 160/207 X |
| 3,750,849 | 8/1973 | Berkovitz | 187/16 |
| 3,757,845 | 9/1973 | Pagliaro | 160/189 |

FOREIGN PATENT DOCUMENTS 730256 5/1955 United Kingdom .

*Primary Examiner*—Rodney H. Bonck
*Attorney, Agent, or Firm*—Newton, Hopkins & Ormsby

[57] ABSTRACT

A vertically collapsing closure system comprising a door consisting of a plurality of rectangular panels in a side-by-side arrangement with each said panel being hingedly connected to each adjacent panel, and a means for operating the door to the full open position by causing the panels to rise vertically until at the height of the opening and then to fold or collapse into a compact terminal stack configuration and then to operate in reverse completing descent vertically once again fully closing the involved opening. The means for causing the door to so operate include panel mounted roller assemblies, vertical structural rail sections to either side of the door, complete in certain cases with cams and other devices, to cooperate with the roller assemblies in guiding and supporting the door in operation, and a counterweight connected to the movable door that has its counterweighting effectiveness varied as a function of the position of components which make up the counterweight to adapt the counterweight to the varying forces exerted by the door during the preferred movement of the door. For automatic operations, required small amounts of external energy and power are applied between door opening and closing sequences.

16 Claims, 70 Drawing Figures

FIGURE 7
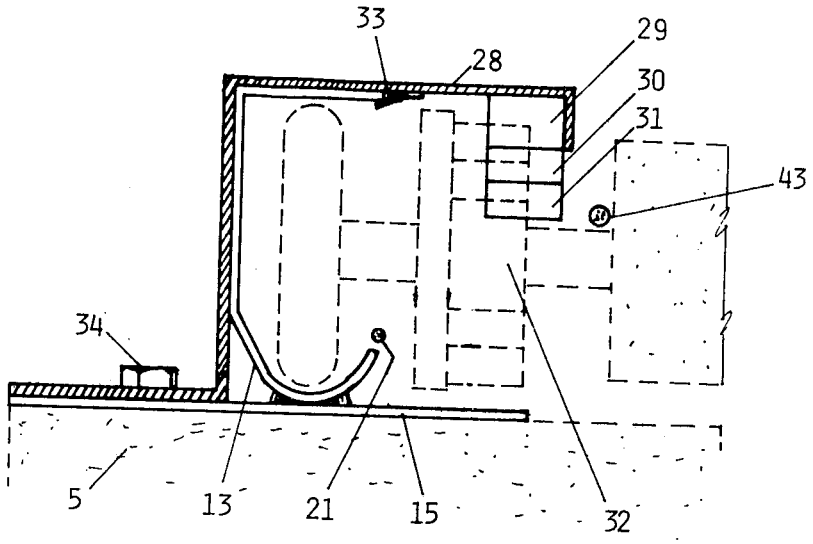
FIUGRE 8
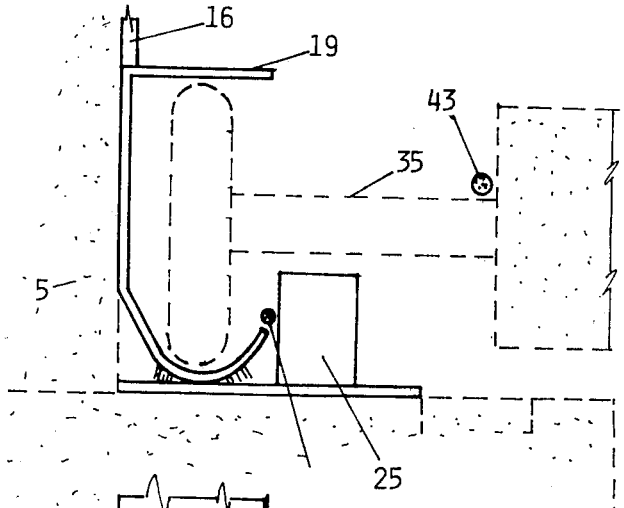
FIGURE 9
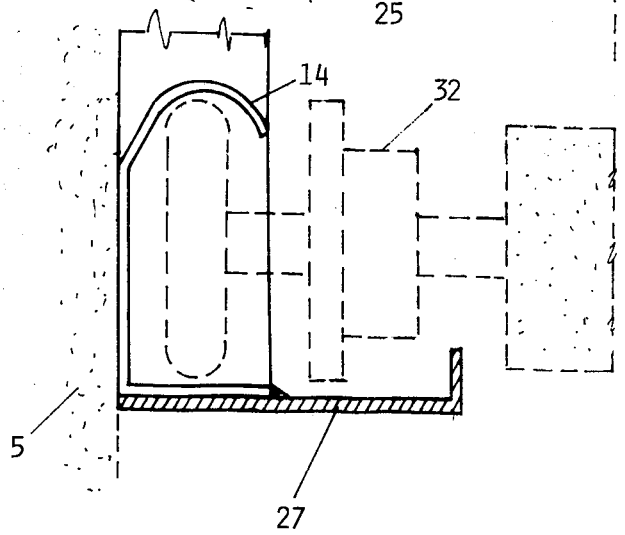

FIG. 14a
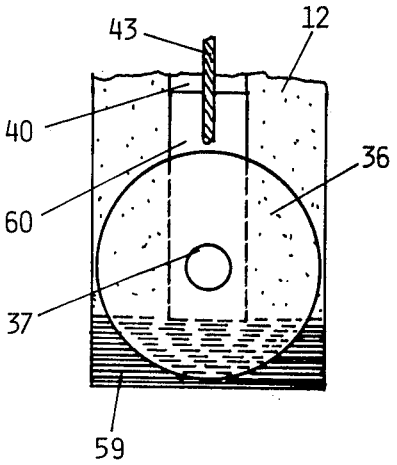
FIG. 14b
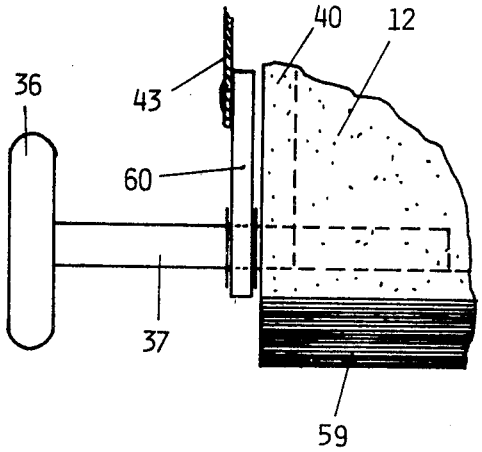
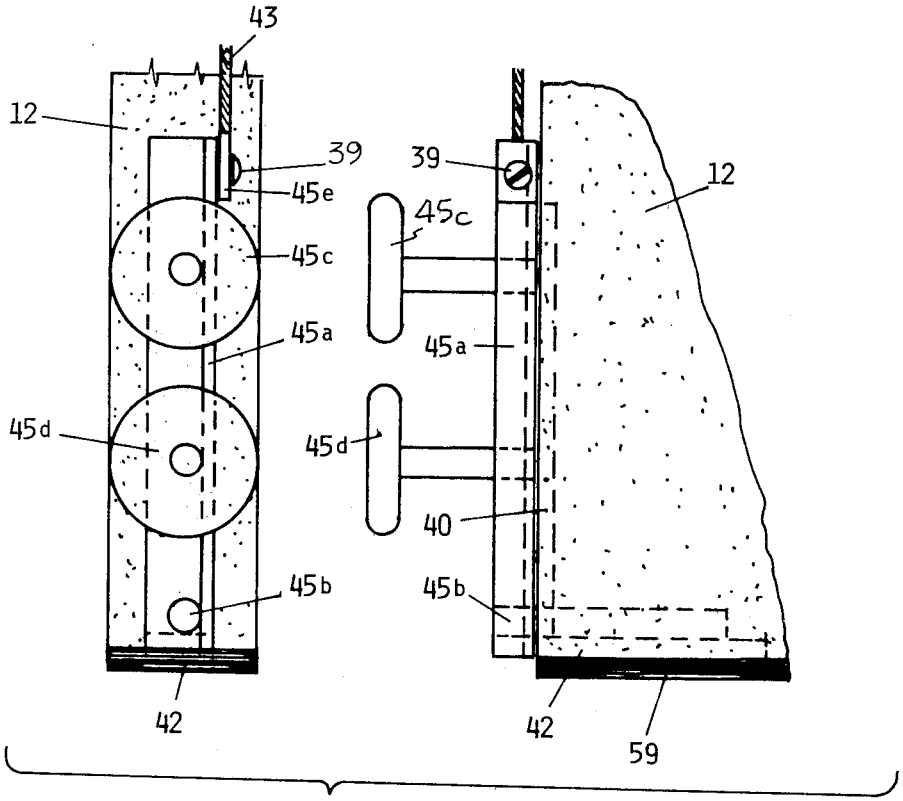
FIGURE 15

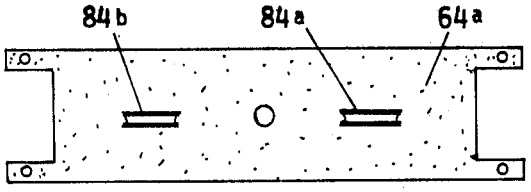
FIG. 29a
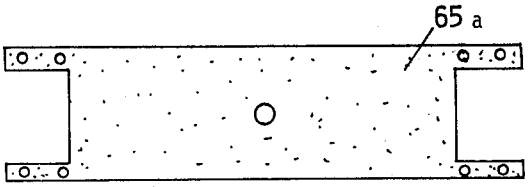
FIG. 29b
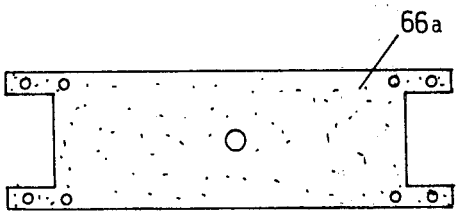
FIG. 29c
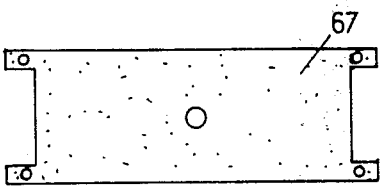
FIG. 29d
FIG. 29e
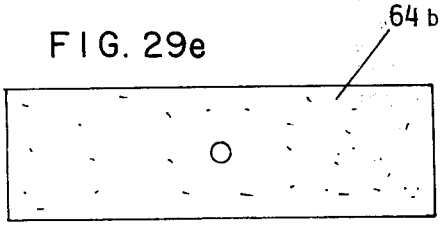
FIG. 29f
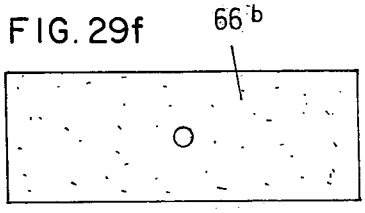
FIG. 29g
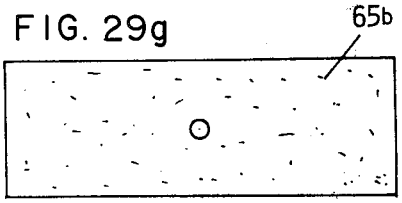
FIG. 29h
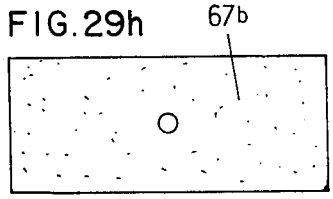

VERTICALLY COLLAPSING CLOSURE SYSTEM

CROSS-REFERENCE TO RELATED APPLICATION

In part, this application prescribes an application of developments included in applications Ser. No. 933,886, filed Aug. 15, 1979 for VARIABLE COUNTERWEIGHT SYSTEMS and Ser. No. 934,402, filed Aug. 17, 1978 for IMPROVED VARIABLE COUNTERWEIGHT SYSTEM.

BACKGROUND OF THE INVENTION

This invention relates to dynamically counterweighted closure system comprising a vertically collapsing segmented door, door roller guide rails promoting the collapse while otherwise guiding door opening and closing and a variable counterweight connected to the operating door to compensate varying dynamic and/or static forces exerted by this load as a known function of its position.

In ordinary overhead closures such as used in residential garage construction, required operating forces are provided by a torsional or extensional spring system as supplemented by an electric motor drive system. Required operating forces are dynamic in nature and do not vary linearly with opening distance. A spring counterweight offers a linearly varying resistance force which is essentially massless and, hence, does not offer most effective counterweighting. Commonly, they now serve as a supplement to an electric motor drive system, the latter being engaged the entire closure opening or closing period. Manual operation is achieved by first disconnecting the motor drive from the door structure and then physically supplementing the energy deficient spring counterweight system. Of course increased door heights and weights complicate application of such closure systems. Spring displacements and forces must significantly increase as well as the electric motor capacity. Differences between the linearly varying spring force and the required non-linear dynamic and/or static operating forces become far more significant. Additionally, in the case of increased door dimensions, there is increased encroachment on valued interior space and further degradation of esthetics.

The object of this invention is to supplement the related reference inventions in providing an industrial as well as residential closure system that minimizes external energy requirements, provides for more flexible closure operating, allows increased design latitude in incorporating energy conservation and architectural options, reduces encroachment upon valuable interior building space and greatly promotes the esthetic value of the enclosed utility space.

The invention minimizes external energy requirements and provides for more flexible closure operation by applying the referenced related inventions. A physical form and operational scheme most appropriate for residential closure construction is featured in this invention. Static and dynamic forces that arise from desired closure operations vary as a known function for every cycle of motion of the door's path. The related inventions allow optimally compensating all such forces that regularly vary in regards to geometry of door position through the use of a counterweight composed of weight components which may be individually arrested during movement of the door at predetermined regular stations. Accordingly, considerable optimal compensation for all static and dynamic operating forces is achieved, whereby the system consisting of load and counterweight at any time is precisely or at least very nearly in equilibrium. This equilibrium also applying to the dynamic forces (accelerations), no appreciable external force is required to initiate or arrest door motion. The kinetic and/or potential energies being generated are entirely recovered within the system, and the supply of external energy is restricted to making good the losses arising from friction, air resistance, etc. The external energy requirement is satisfied by electric power either between the closure opening and closing periods or during one of the latter periods. Accordingly, the electric power can be applied at the desired rate of door operation to affect either opening or closing with the return in both cases being achieved strictly under the influence of the counterweights only. Alternately, both opening and closing may be achieved under the influence of the counterweights only with the electric power being applied between these two motion stages at any desired rate, the lower rates requiring reduced external electric power levels. However, the operation of the closure is never exclusively dependent on the electric power. At the option of the operator, the closure may be exercised manually with the required minimized external energy being applied manually during the opening or closing of the door. As a consequence of such dynamic counterweighting tailored according to operating demands, there is less significance of door weight increases that may be necessary to accommodate certain architectural or energy conservation measures. The latter do not result in operating or initial electric motor purchase costs penalties. The counterweight system allows moving very heavy and large doors in short time periods, without requiring large power machinery. In all cases, required output is restricted to that energy which will replenish the looses within the available time, with the available time generally exceeding the operating time when the option is exercised to apply the minimum required external energy during operational pauses, so that very low power suffices to this end.

The invention significantly reduces encroachment upon valuable interior building space through the use of a segmented door that collapses vertically during the opening stage. When the door is in an opened position, occupied useable space is limited in overhead cabinet roughly equal in dimensions to the width of the door, the height of one door segment and the combined thickness of the door segments. Door roller guide rails are compactly positioned vertically along the door casing into the overhead cabinet with mounting onto its end panels. Since the door sections only begin to collapse at the upper level of the opening, door operations do not encroach on any useable space other than that required by the overhead storage cabinet. The counterweight system and connecting cables may be compactly placed within the wall cavity, usually consisting of stud/sheathing construction. The overhead ceiling area usually reserved for an overhead door in its opened horizontal configuration is not required and may be used for other building utility systems such as lighting or ducting or otherwise unencroached upon. Accordingly, the invention also greatly promotes the esthetic value of the enclosed space. Architectural attractiveness is not limited to the exterior alone as currently is common practice. There are no unsightly interior features. More positively, the invention provides a closure system that is most adaptable to attractive interior design. For example, the appearance of a residential garage may now be made compatible with the many various functions they now serve in addition to that of vehicle storage. Increased space utilization may be exploited. Certainly, the residential garage potentially offers far more complete versatility in meeting changing family demands for effective dual use interior home area than is now possible with today's unattractive energy inefficient garage door systems.

A preferred embodiment of the dynamically counterweighted closure system of the invention comprises a vertically collapsing segmented panel door; adjoining vertical roller guide rails cam equipped in certain cases, to promote controlled vertical door motion and panel collapse and an adaptation of the counterweight systems of the referenced inventions comprising several partial weights in the counterweight, which are detachably connected to the door load, further devices which separate individual partial weights from the door load at predetermined points of the path of the counterweight and additional devices which apply external energy to the counterweight system by inducing relative displacement between certain of the partial weights.

Further characteristics and advantages of the invention are discussed in the description below the embodiments and in relation to the drawings.

FIG. 1 is a sketch of the closure system of the invention as viewed from the interior of the enclosed space;

FIGS. 2*a* through 2*g* are schematic elevational views of a closure system of the invention in various operational stages for the purpose of explaining the basic principles of the invention;

Figure 5:
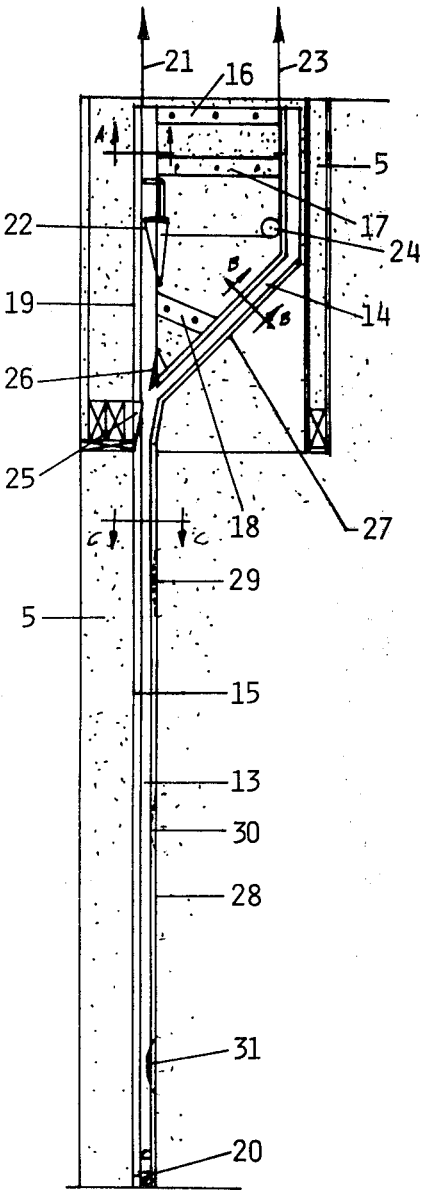
FIG. 5 is the side view of the erected side roller guide rail component of FIG. 3 as completed by the installation of a covering guide rail raceway.
Figure 10A:
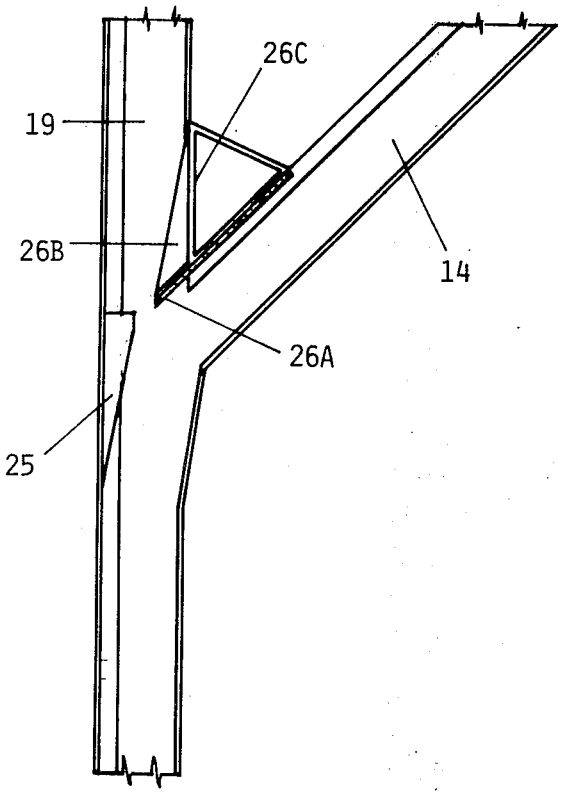
Figure 11:
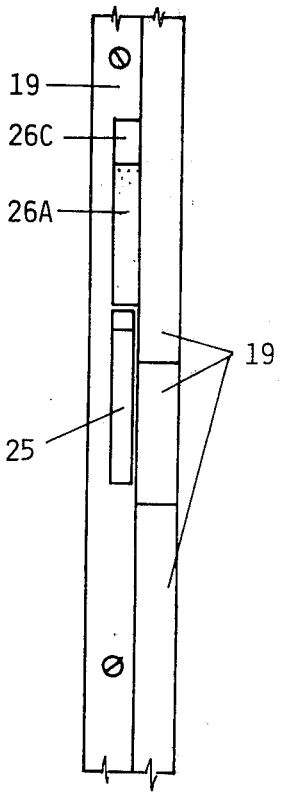
Figure 10B:
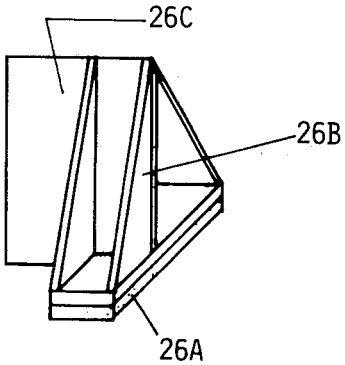
Figure 12A:
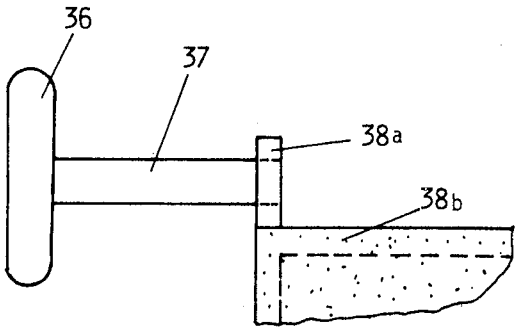
Figure 12B:
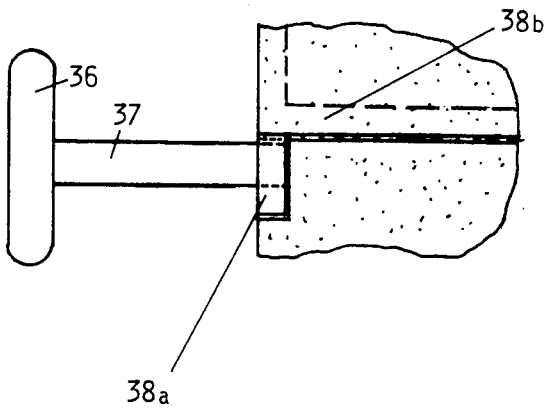
Figure 12C:
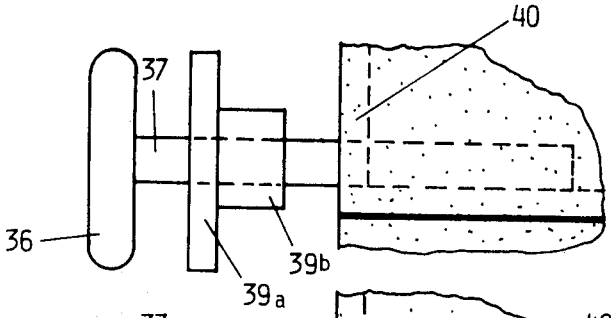
Figure 12D:
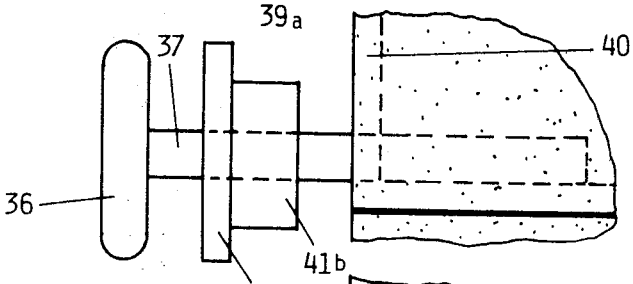
Figure 12E:
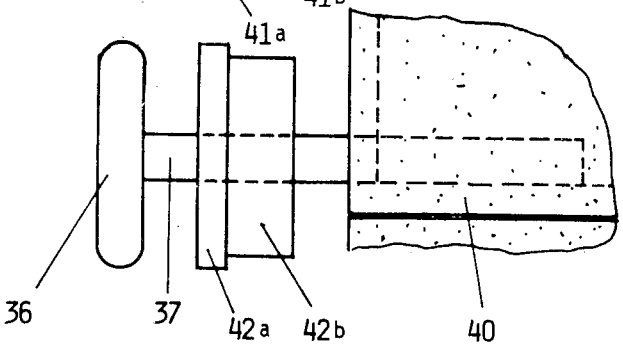
Figure 13:
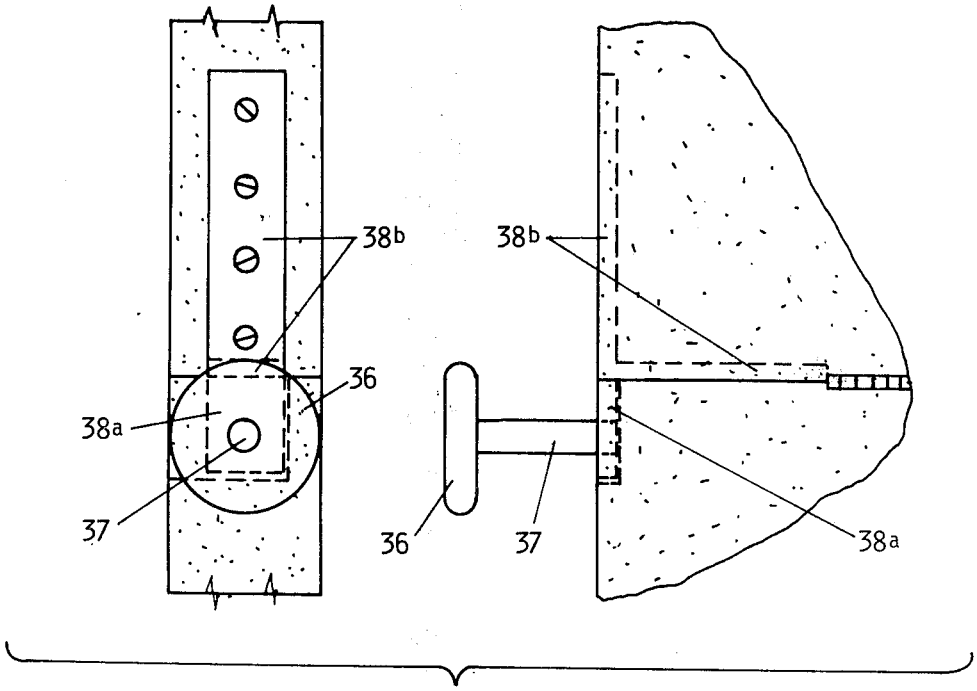
Figure 16:
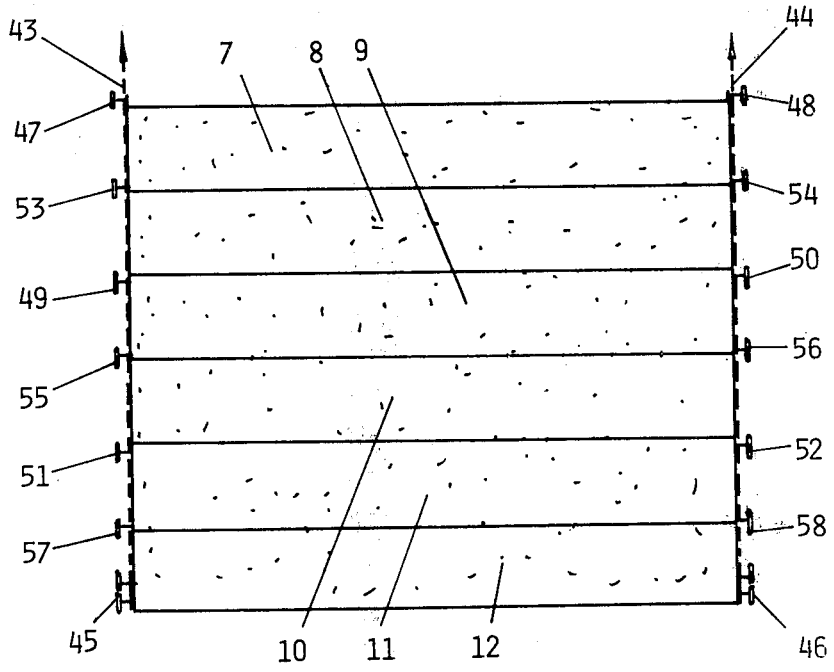
Figure 18A:
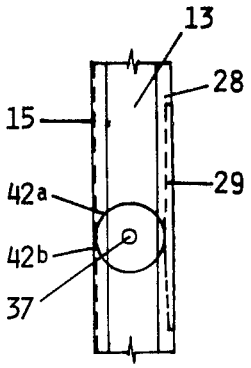
Figure 18B:
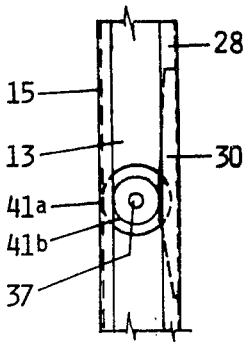
Figure 18C:
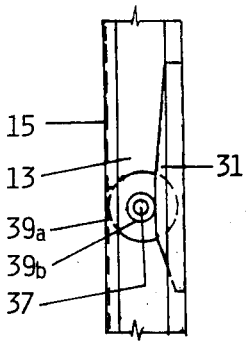
Figure 17:
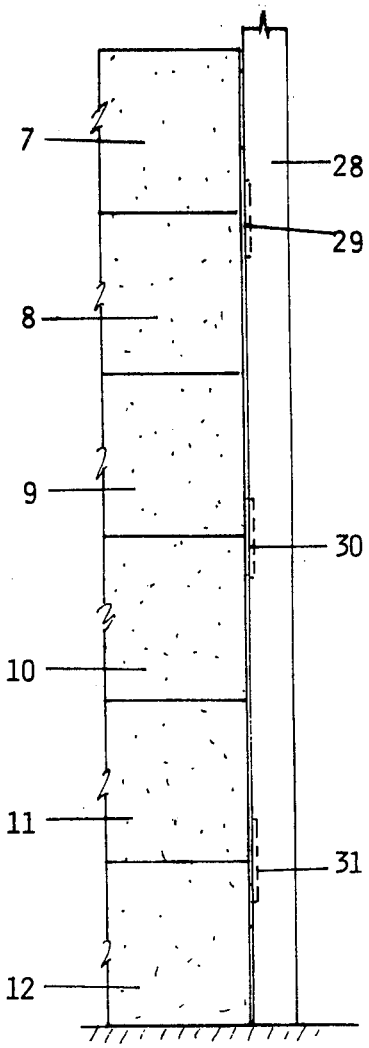
Figure 19:
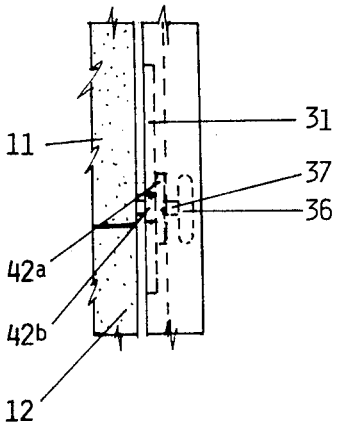

FIG. 7 provides the roller guide rail cross-sectional view designated in FIG. 5 as Section C—C;

FIG. 8 provides the roller guide rail cross-sectional view designated in FIG. 5 as Section A—A with roller position superimposed;

FIG. 9 provides the roller guide rail cross-sectional view designated in FIG. 5 as Section B—B with roller position superimposed;

FIG. 10*a* is a fragmentary side elevation of an upper roller guide rail, deflection cam, intercept plate and associated elements;

FIG. 10*b* is a perspective view of the roller intercept plate;

FIG. 11 is an end view of the portion of upper roller guide rail component shown in FIG. 10;

FIGS. 12 through 12*e* are fragmentary side elevations of the guide/support roller assemblies exclusive of those on the lowest door panel;

FIG. 13 shows the front and side view of the guide roller assembly that tracks vertically to the collapse position without diversion from the main roller guide and is generally mounted on the lower corners of alternate panels;

FIGS. 14*a* and 14*b* are front and side views of the lower guide roller/lifting cable attachment assembly as mounted on the lower corners of the lowest door panel;

FIG. 15 is the front and side view of the lower guide roller/lifting cable attachment assembly as mounted on lower corners of the lowest door panel in the event guide roller contact with the floor precludes the use of the assembly of FIG. 14;

FIG. 16 shows schematics of the segmented panel door as equipped with guide rollers as appropriately equipped, in certain cases, to engage rail-mounted directional cams;

FIG. 17 is the front view of the interior right hand juncture of door panels and roller guide rail with rail cover in position illustrating the approximate positions of the installed sealing cams shown in FIGS. 18 and 19;

FIGS. 18*a* through 18*c* are side elevations showing segments of the roller guide assembly containing closed door sealing cams and related guide rollers;

FIG. 19 is an end view of the lower door sealing cam assembly and adjoining roller guide rail segment shown in FIG. 18*c;*

Figures 2A, 2B, 2C, 2D, 2E, 2F, 2G:
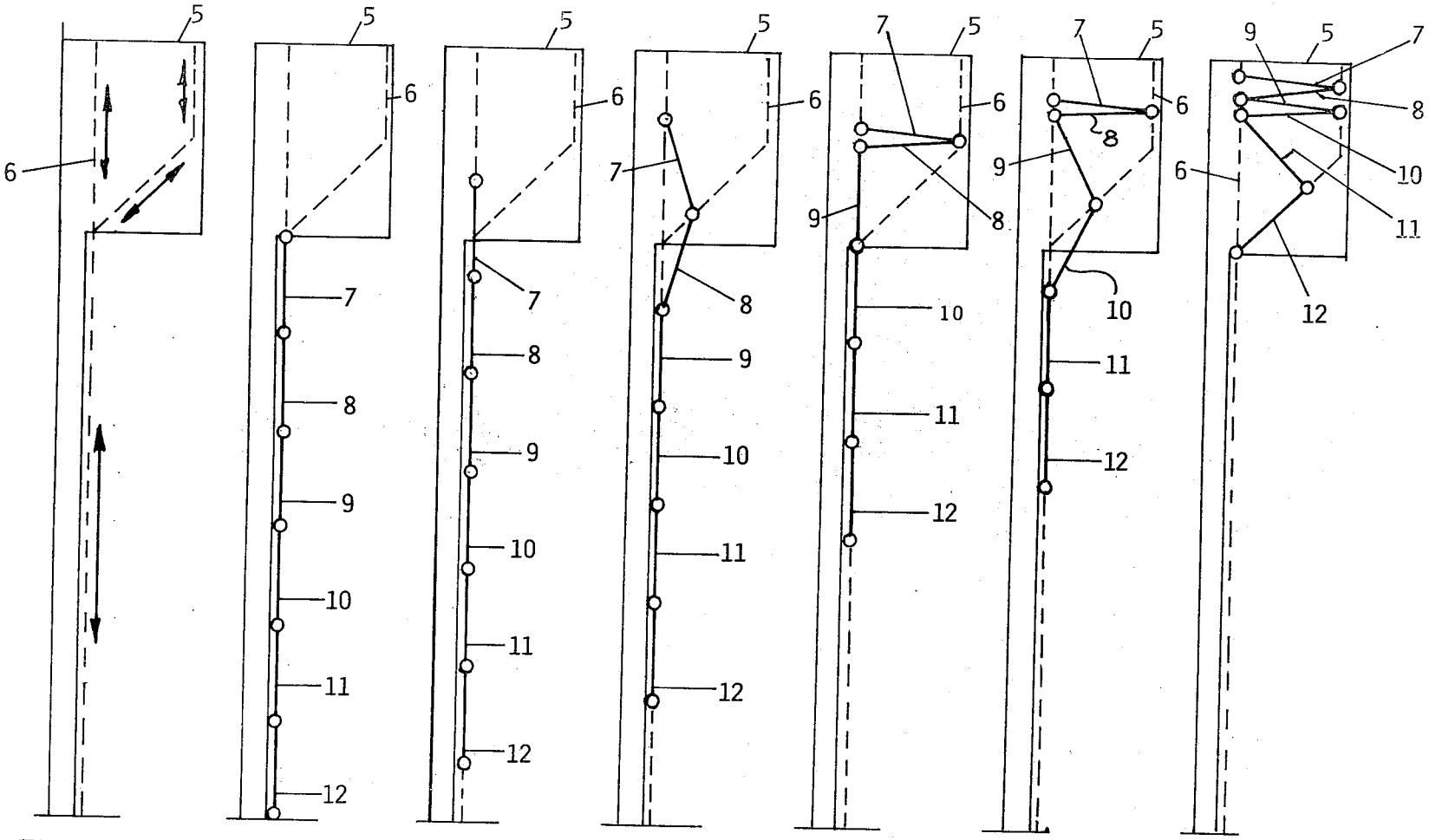
Figure 20:
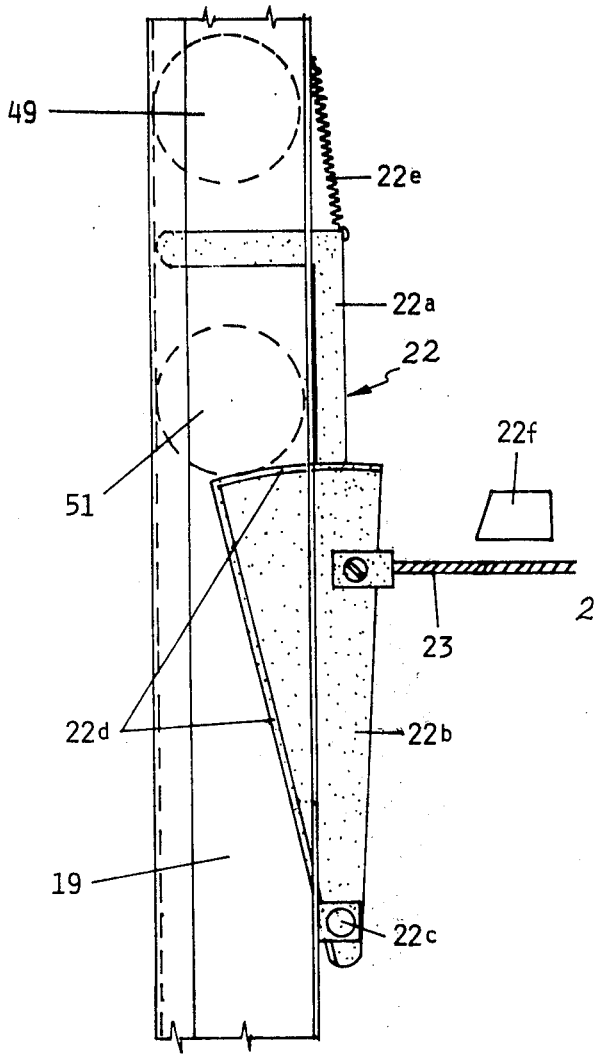
Figure 21:
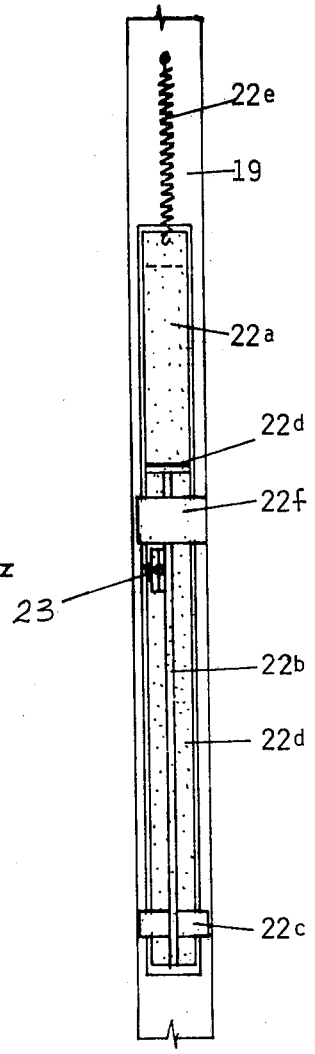
Figure 22:
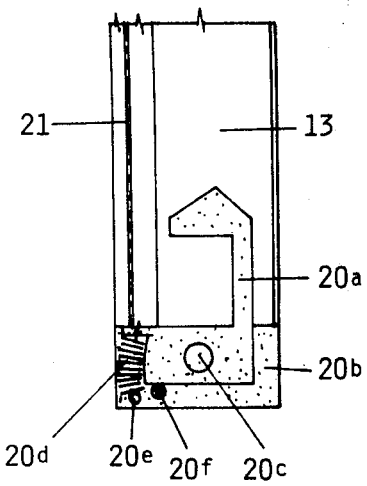
Figure 23:
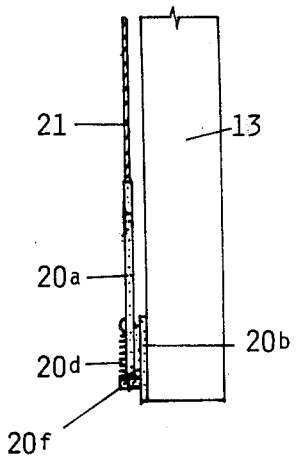
Figure 24:
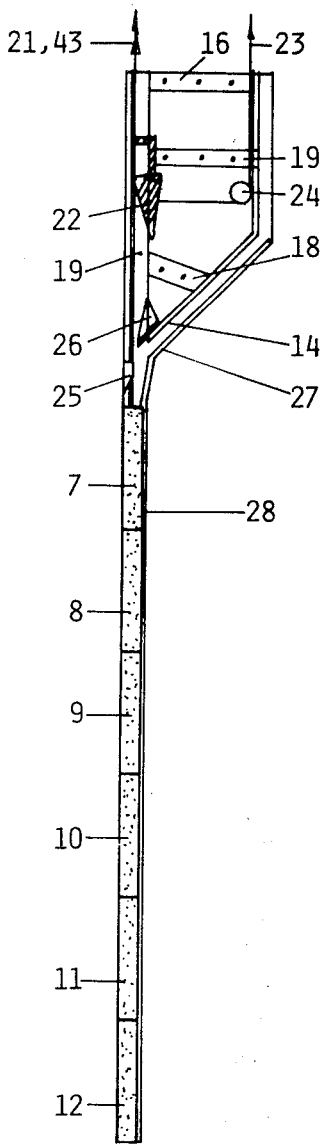

FIG. 20 is the side view of the upper locking device and for securing the door of the embodiment in its open position with door panels collasped;

FIG. 21 is an end view of the locking device of FIG. 20;

FIG. 22 is the side view of the lower locking device used for securing the door of the invention in its closed position with door panels vertically aligned in their upright position against the door jamb;

FIG. 23 is an end view of the locking device of FIG. 22;

FIG. 24 illustrates the closed door configuration of the embodiment of the invention using a vertical cross-sectional view of the door and, as such, relates to the closure's operational stage illustrated in FIG. 2*b;*

Figure 25:
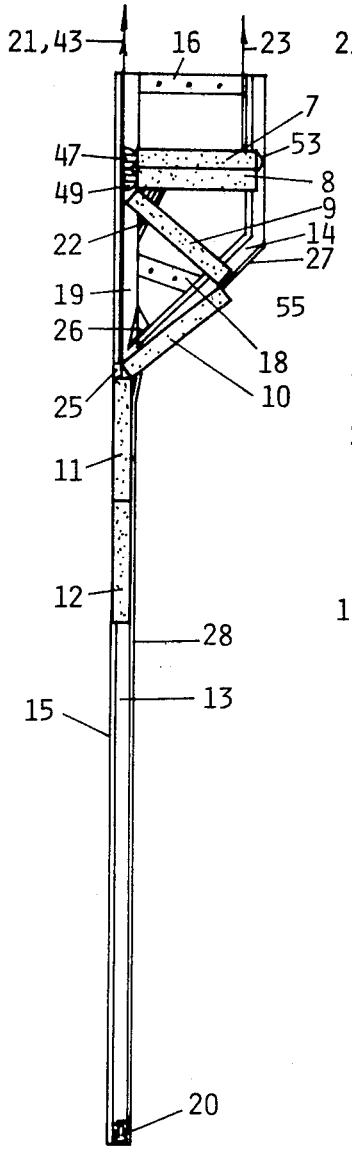

FIG. 25 illustrates an intermediate opening door configuration of the invention using a vertical cross-sectional view of the door; and, as such, relates to the closure's operational stage illustrated in FIG. 2*f;*

Figure 26:
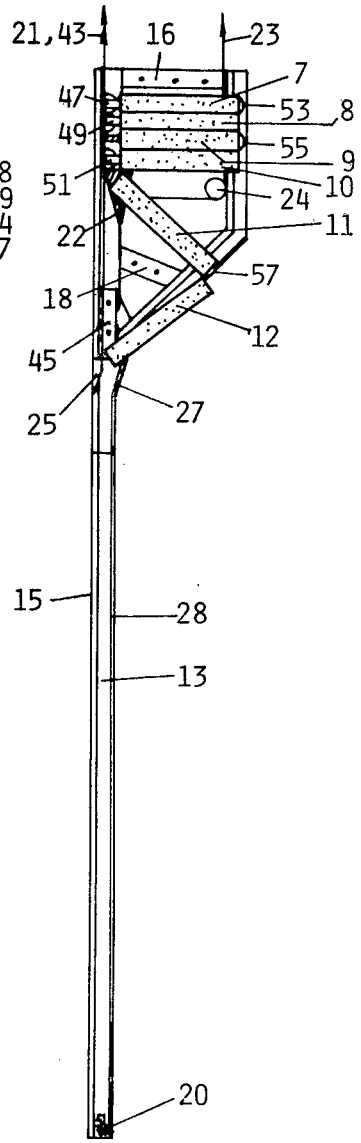

FIG. 26 illustrates the full open door configuration of the embodiment of the invention using a vertical cross-sectional view of the door; and, as such, relates to the closure's operational stage illustrated in FIG. 2*g;*

Figure 3:
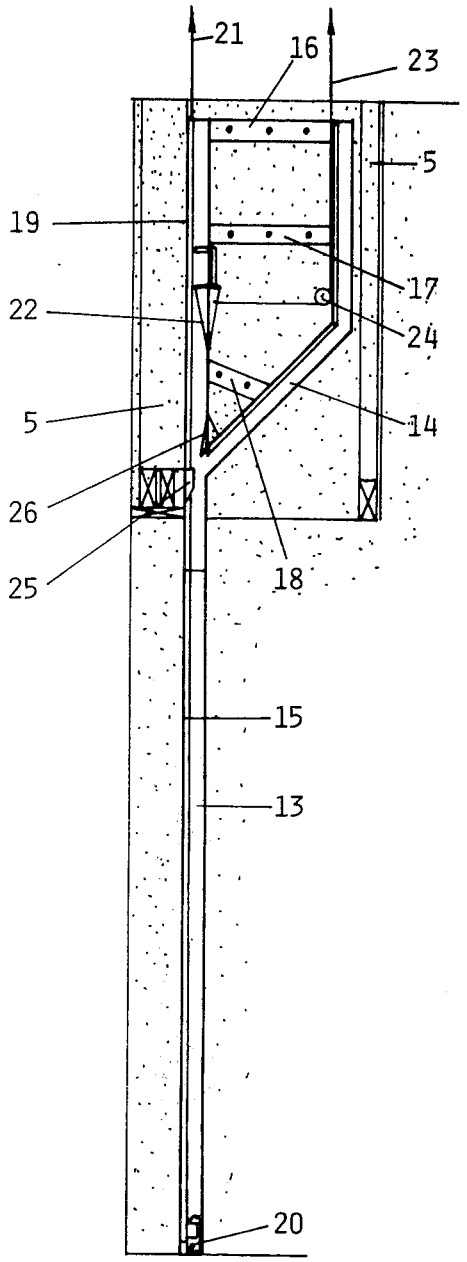
FIG. 3 is the side view of an erected side roller guide rail component with upper and lower sections in place but without its covering rail raceway.
Figure 27:
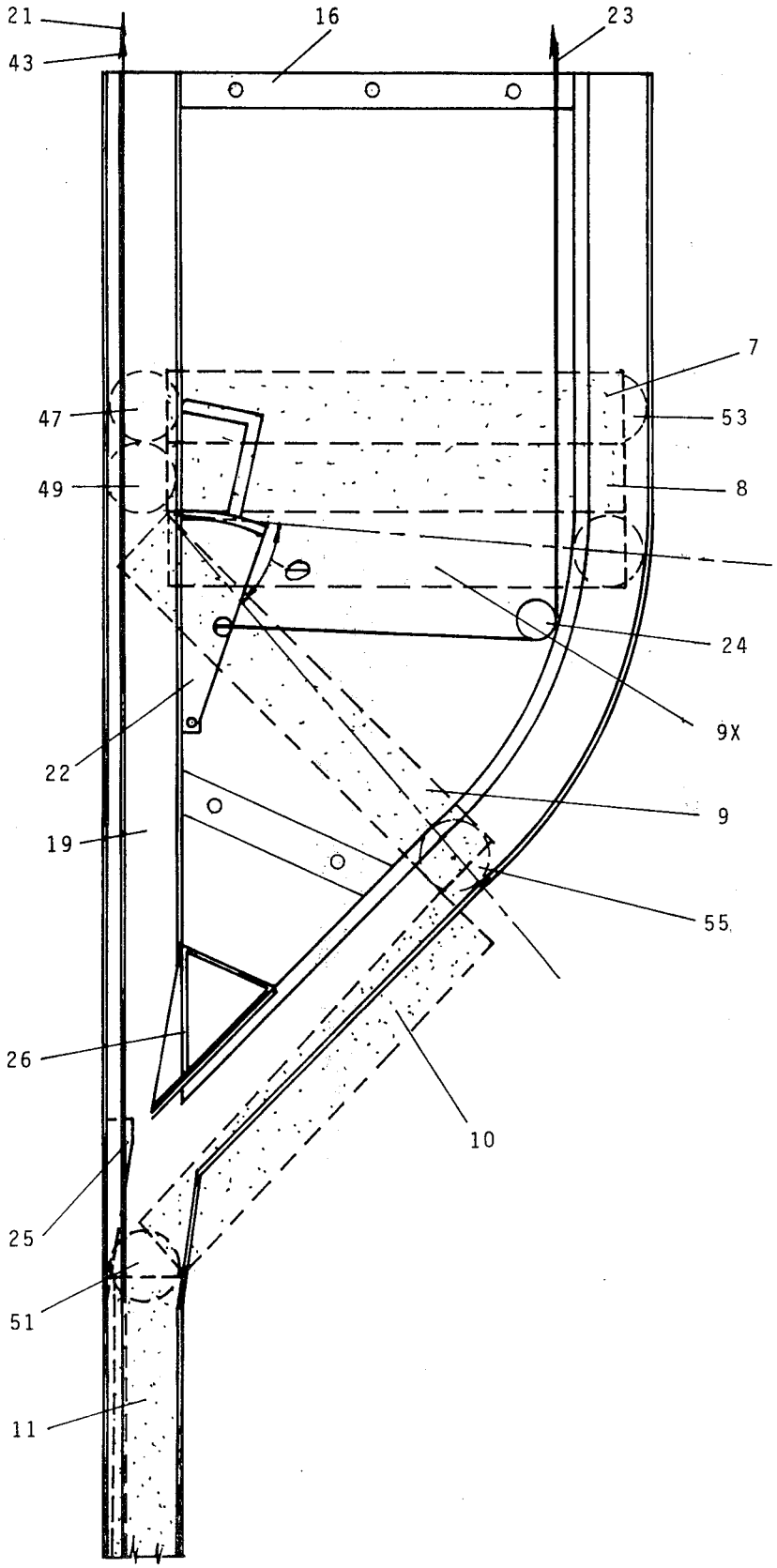
Figure 28:
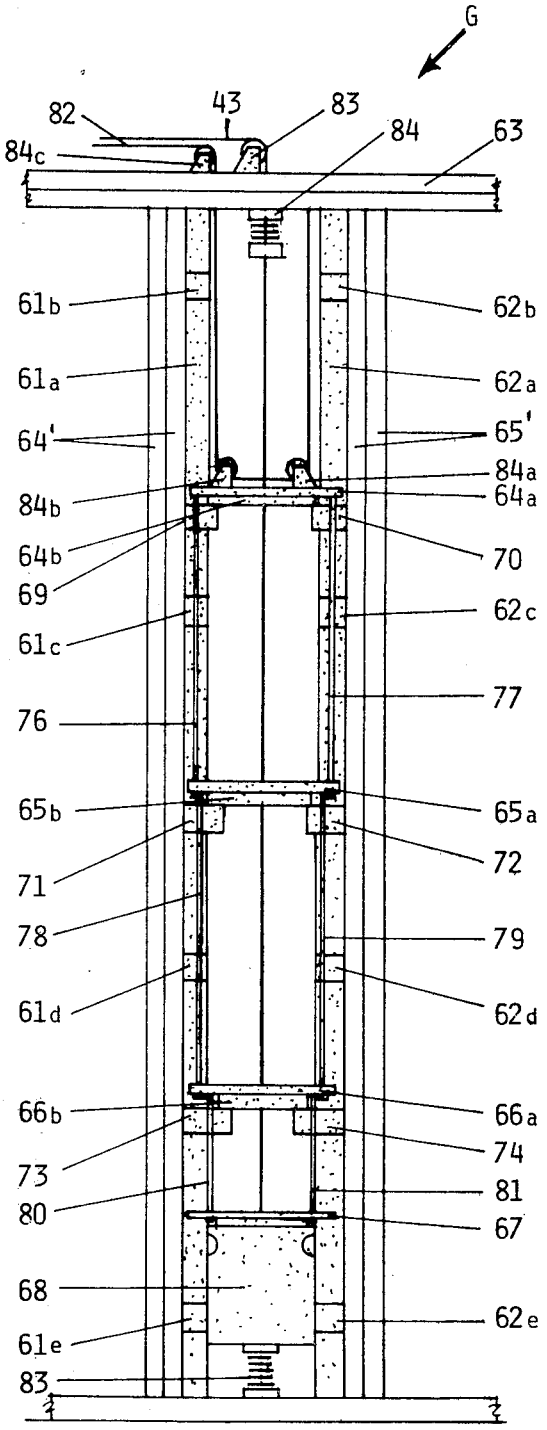
Figure 30:
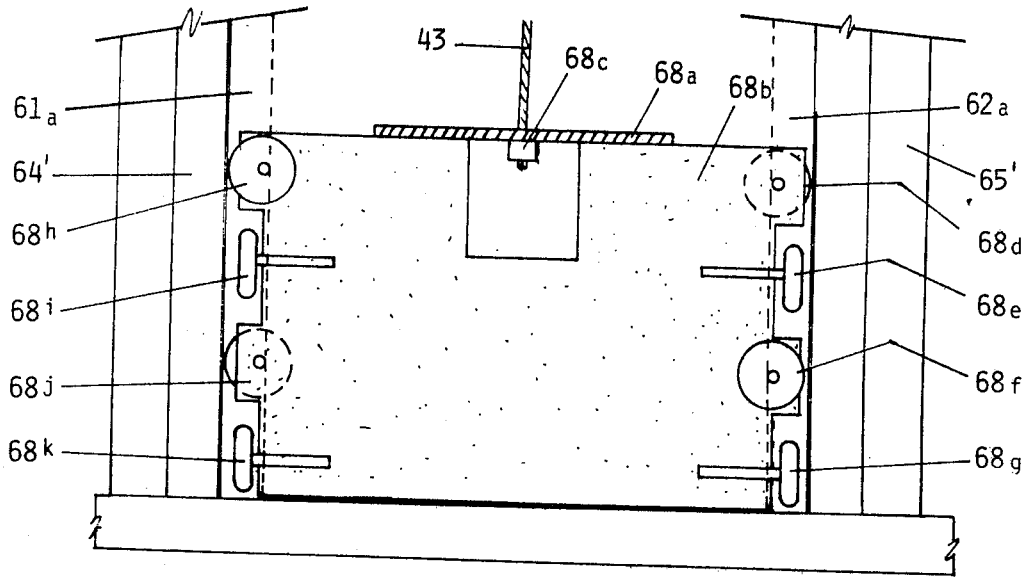
Figure 31:
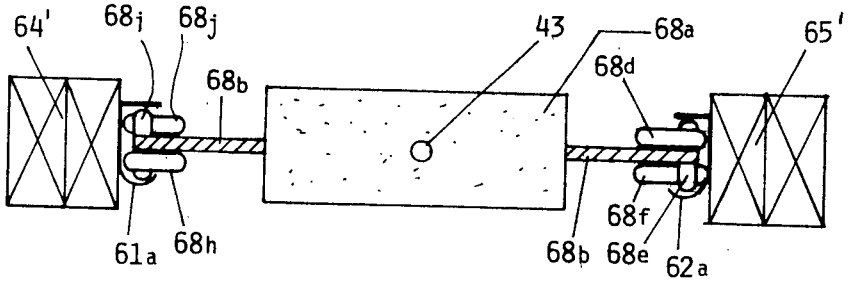
Figure 32:
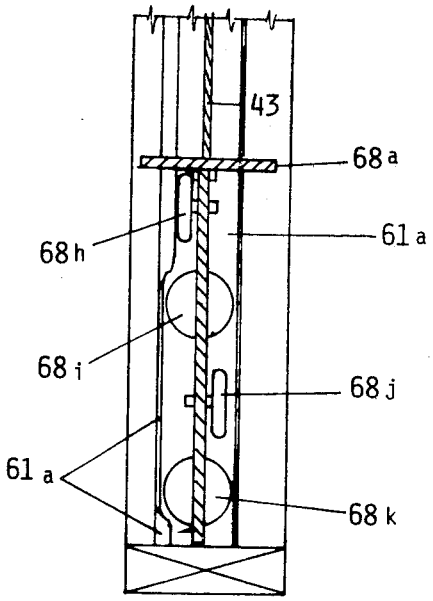
Figure 33:
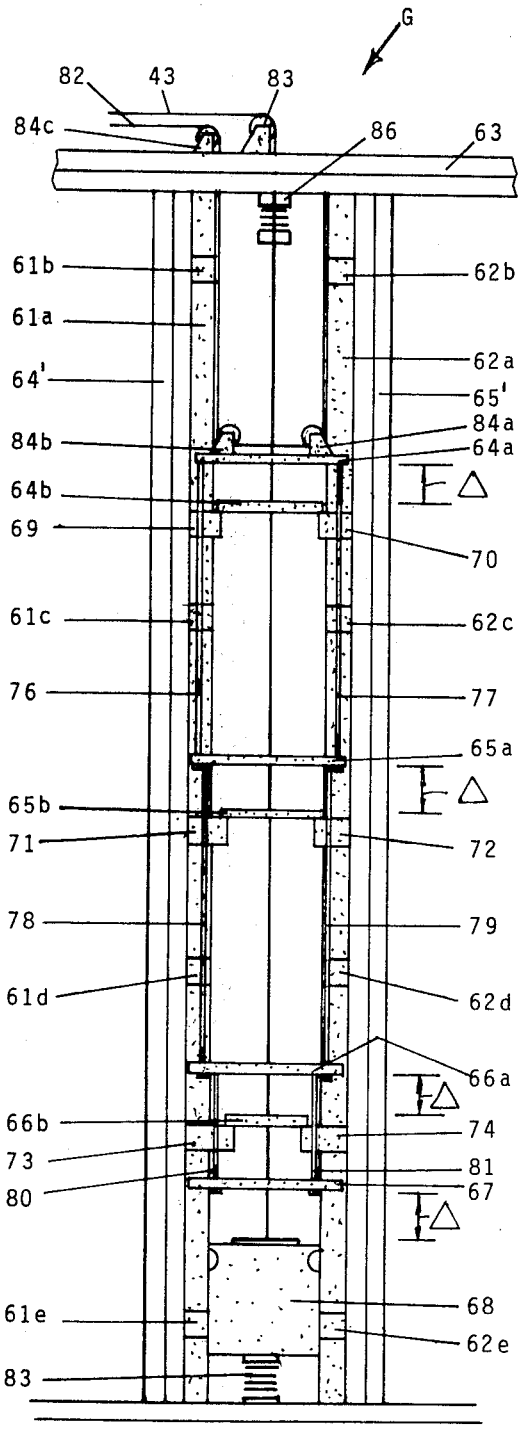
Figure 34:
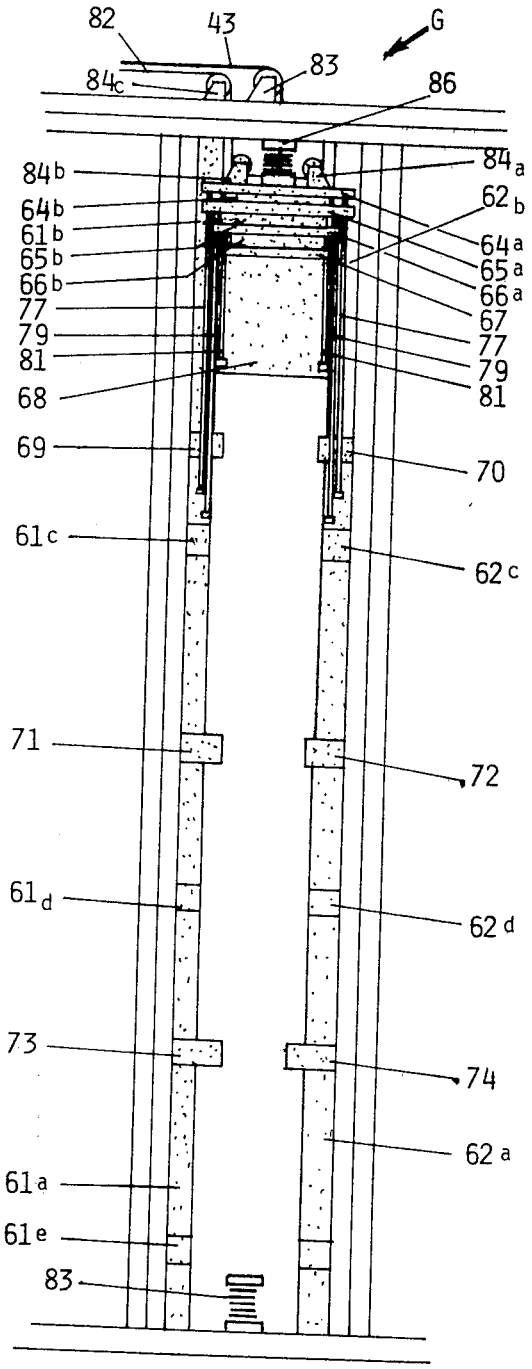
Figure 35:
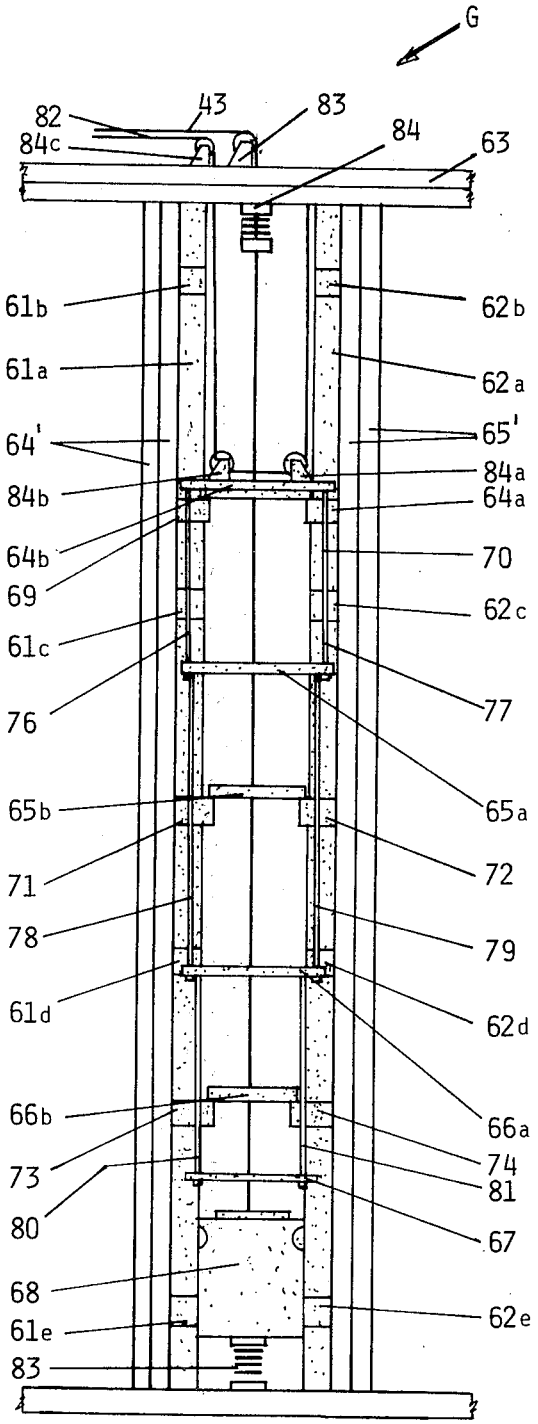
Figure 37B:
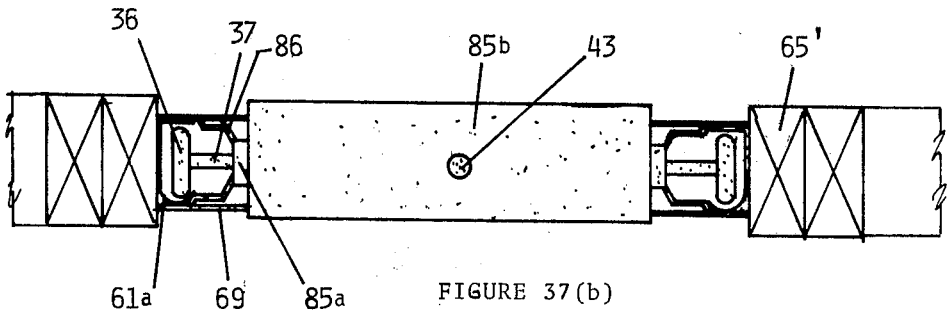
Figure 37A:
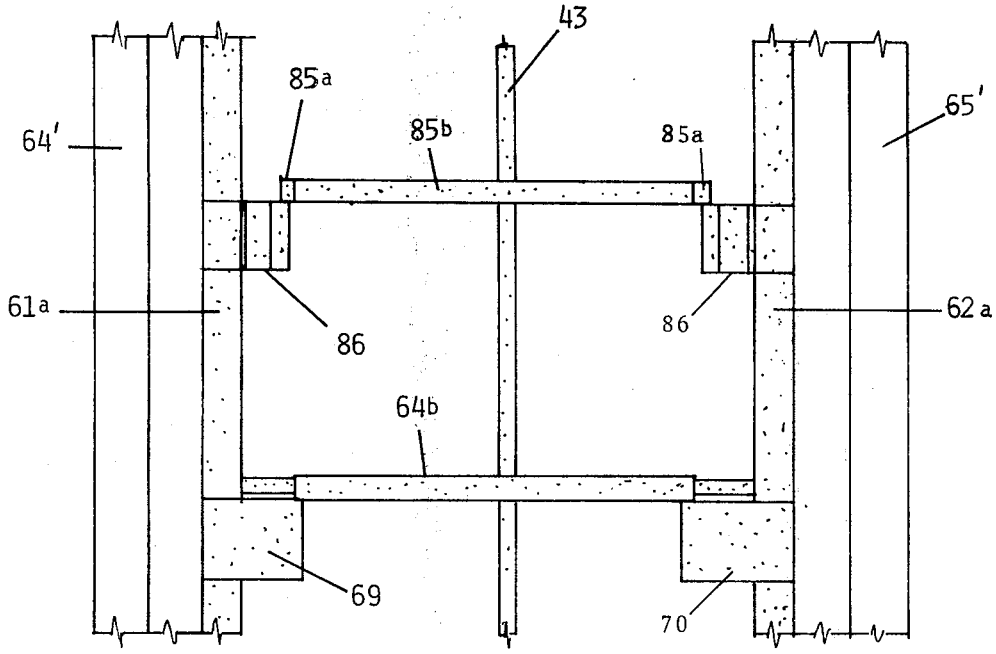
Figures 38, 39:
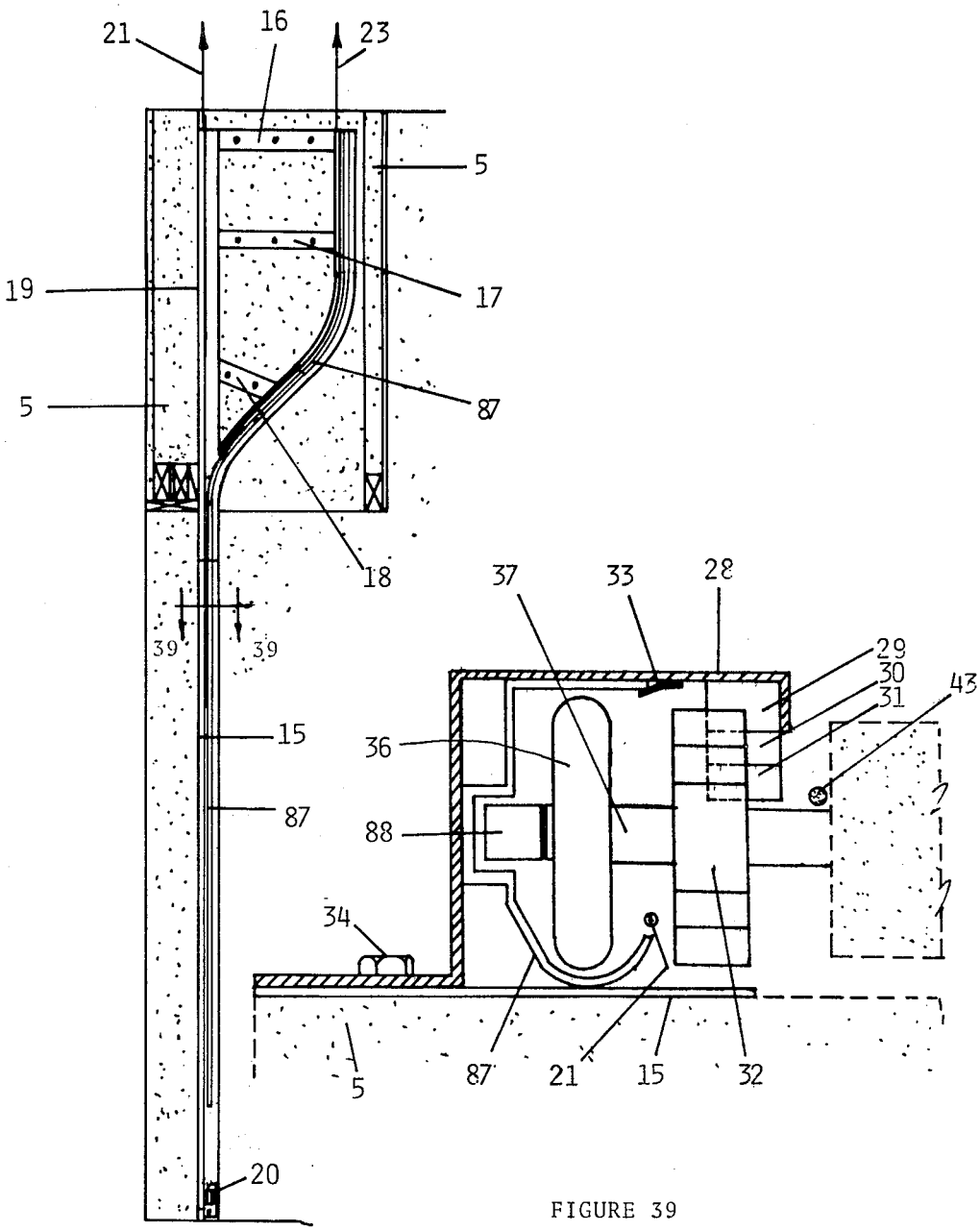
Figure 40A:
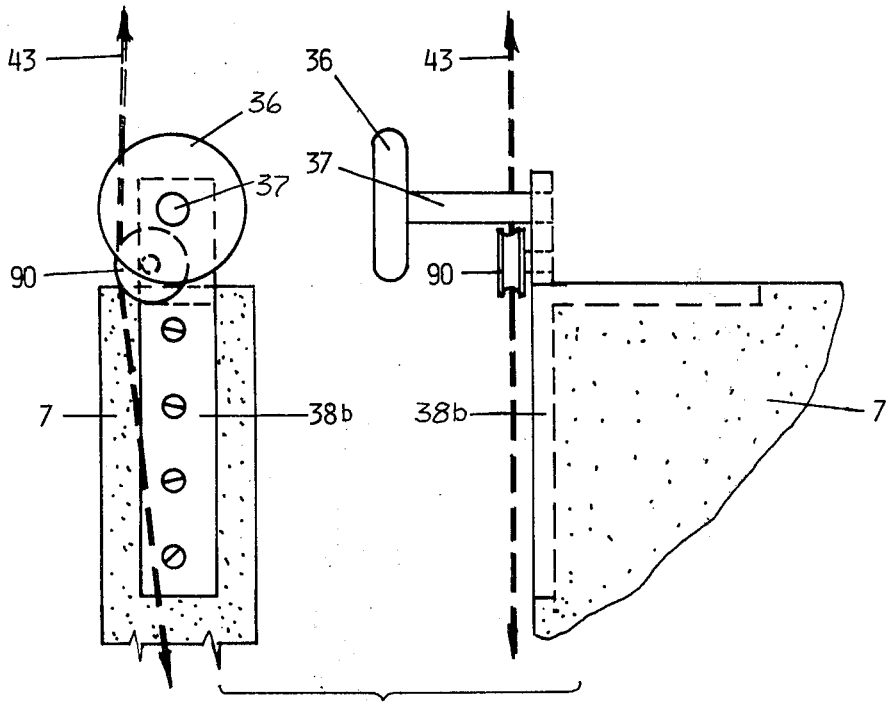
Figure 40B:
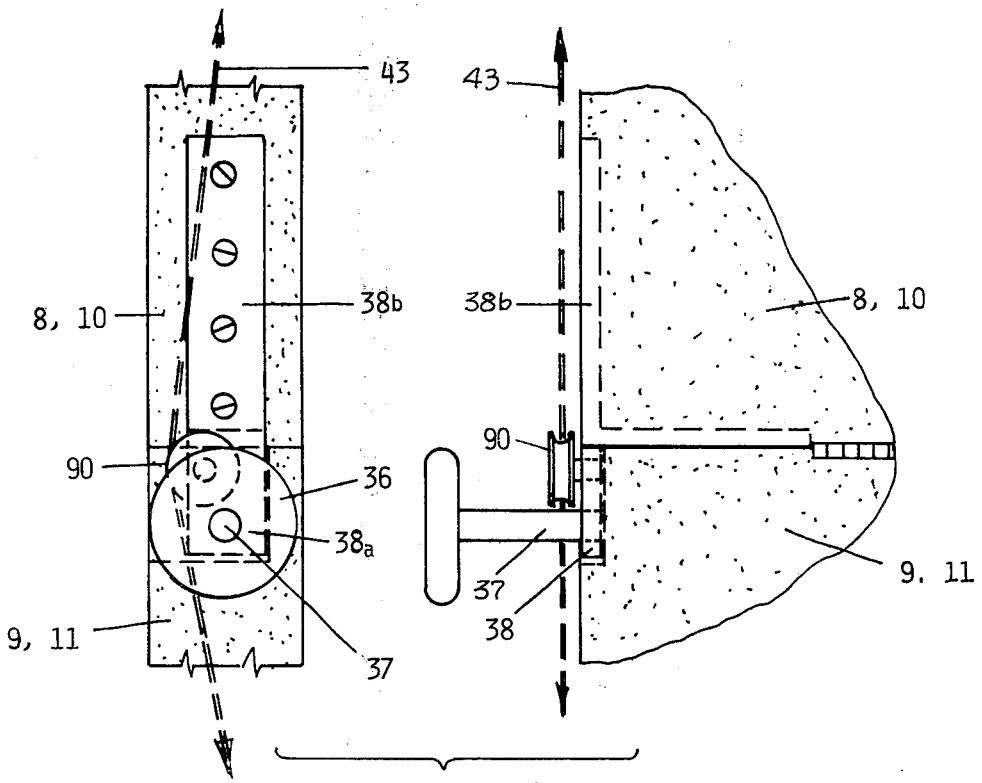
Figure 41A:
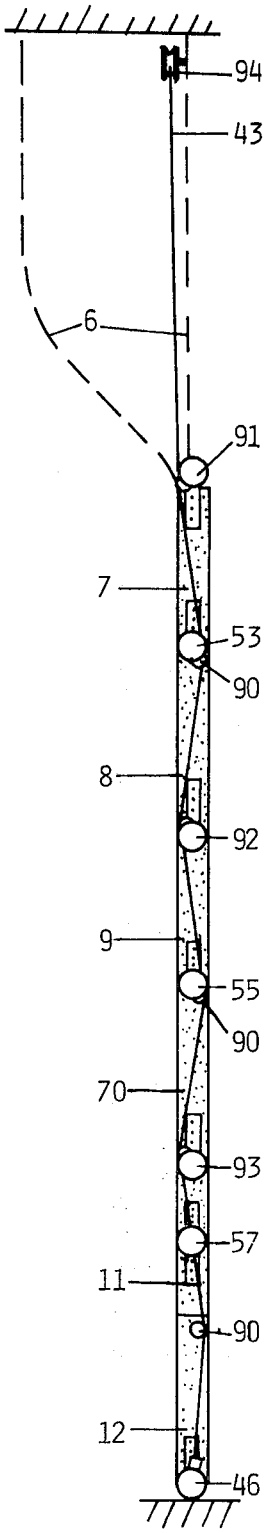
Figure 41B:
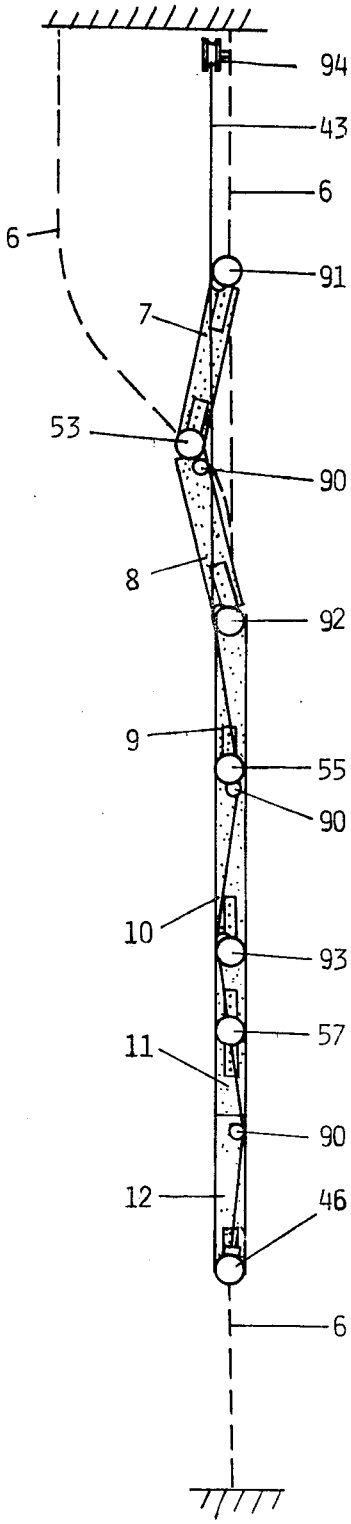

FIG. 27 is another embodiment of the upper section of the roller guide rail component of the invention showing superimposed the door panels in an intermediate collapsed position;

FIG. 28 is a schematic elevation of another embodiment of the counterweight system of the referenced invention as utilized in this invention and relevant to the open door configuration;

FIGS. 29*a* through 29*h* are a series of plan views of counterweight elements shown in elevation in FIG. 28;

FIG. 30 is a side elevation of the counterweight elements' platform which travels in the roller guide rails of the counterweight system of this invention;

FIG. 31 is a top view of the counterweight elements' platform shown in FIG. 30;

FIG. 32 is an end view of the counterweight elements' platform shown in FIG. 30;

FIG. 33 is a schematic of the counterweight system of FIG. 28 showing the changed relative positions of counterweights resulting from the application of external electrical energy subsequent to the opening and prior to the closure of the door of this invention;

FIG. 34 is a schematic of the counterweight system of FIG. 28 as relevant to the closed door configuration;

FIG. 35 is a side elevation of still another embodiment of the counterweight system of the referenced invention as utilized in this invention and relevant to the open door configuration;

FIGS. 36*a* through 36*d* are diagrams of effective counterweight force variations resulting from intermediate external energy input and varied positions of stop means;

FIG. 37*a* is a fragmentary side elevation of a modified type of counterweight support platform system;

FIG. 37*b* is a fragmentary plan view of the same, partly in section;

FIG. 38 is a view similar to FIG. 3 showing an alternate form of roller guide rail and diversion guide roller system;

FIG. 39 is an enlarged fragmentary horizontal section taken on line 39—39 on FIG. 38;

FIG. 40*a* is a fragmentary side and front elevation showing an alternate form of guide roller assembly shown in FIG. 12*a* as modified to include a cable directional sheave;

FIG. 40*b* is a fragmentary side and front elevation showing an alternate form of guide roller assembly shown in FIG. 12*b*, as modified to include a cable directional sheave;

FIG. 41*a* is a side elevation of the segmented panel door in closed configuration with panels equipped, in certain cases, with the alternate guide roller assemblies of FIG. 40 and in other cases, with regular roller assemblies of FIGS. 12, 14 or 15 as well as cable directional sheaves;

FIG. 41*b* is a side elevation of the segmented panel door of FIG. 41*a* as configured during an early state of opening.

Figure 1:
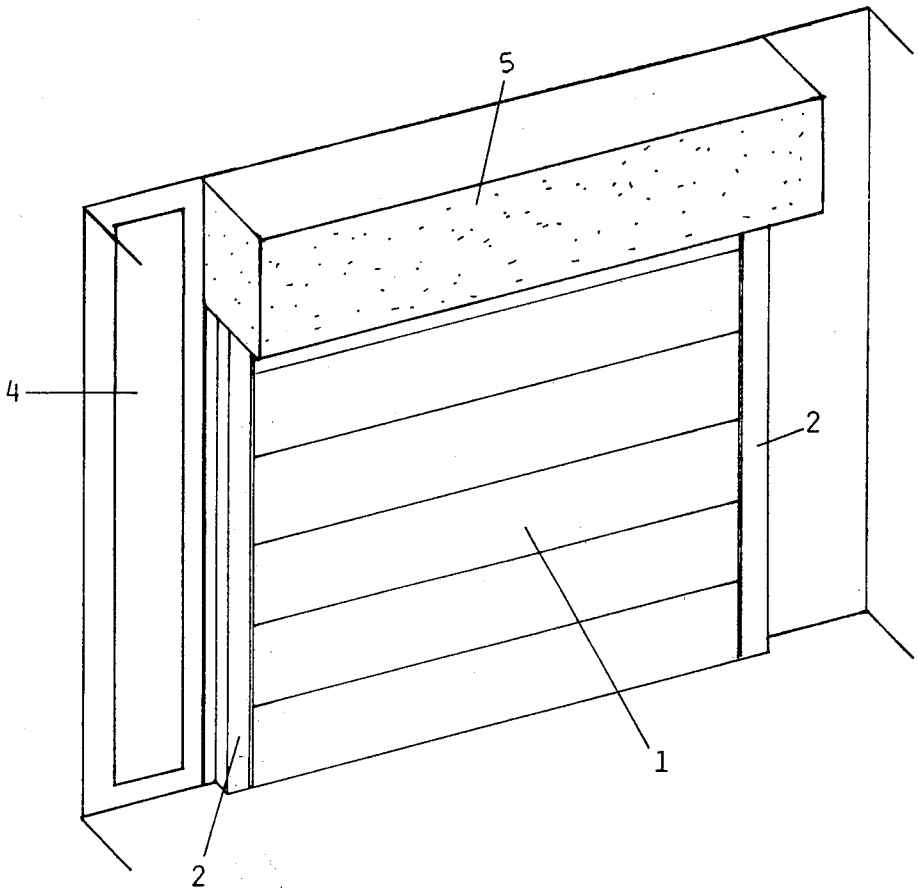

FIG. 1 is a schematic of the interior view of an embodiment of the dynamically counterweighted vertically collapsing closure system of the invention. The segmented door elements are guided vertically by concealed door roller guide side rails enclosed within the roller guide side rail raceways 2 and extending into the overhead cabinet 5 built into the exterior wall to enclose the door panels which are either in an intermediate or terminal collapse configuration. Door motion is caused by a variable dynamic counterweight system mounted and concealed within the wall section. FIG. 1 illustrates the access panel 4 to the counterweight system as located in this case adjacent to the door. Concealed cables connect the concealed counterweight system to the lower panel of the segmented door 1.

FIG. 2 illustrates the manner in which the segmented door 1 is opened through a process of vertical collapse. Closure is achieved through the reverse process.

FIG. 2*a* is a schematic illustrating the general location of the overhead cabinet 5 and wall section 4 and travel directions of guide rollers attached to the vertical edges of the segmented door 1. This schematic may be thought of as an outline of a cross-sectional view of the perspective 5 shown in FIG. 1.

FIG. 2*b* is the schematic FIG. 2*a* extended to include the panels of the segmented door 7, 8, 9, 10, 11, 12 as positioned within the door in a closed configuration. The panels are hinge joined at their junctures and equipped with end rollers indicated by the small circles. As will be explained, cams have been used to thrust the rollers at the junctures of panels 7 and 8, 9 and 10, and 11 and 12 firmly against the roller guide rail in the direction of the door opening thereby sealing the side and upper door perimeter against the door jamb and header respectively.

FIG. 2*c* is the schematic of FIG. 2*b* as modified to illustrate initial opening action of the door. A lifting force has been applied to the bottom of panel 12. All panels have lifted by a common amount in the vertical direction.

FIG. 2*d* illustrates the beginning of the door collapse sequence of this invention. The roller at the juncture of panels 7 and 8 has been mechanically deflected laterally and otherwise caused to travel in the inclined direction producing a relative angle of rotation between the first and second panels 7, 8 and second and third panels 8, 9. The other panels 9, 10, 11, 12 are continuing to move in the upward vertical direction.

FIG. 2*e* illustrates continued opening of the door. The roller at the juncture of panels 7 and 8 has not been deflected laterally and hence continues to travel vertically affecting the complete folding of panels 7 and 8. Panel 8 has ceased to rotate and now travels in the vertical upward direction only. Door opening will continue in this manner with alternate guide rollers being intercepted and deflected laterally to cause diagonal travel of the same. Other adjacent guide rollers will continue to travel vertically.

FIG. 2*f* illustrates this continued opening action.

FIG. 2*g* illustrates the terminal configuration of the door as opened through upward motion and systematic collapse of the individual panels. It should be noted that panels 11 and 12 are left in an inclined configuration with panel 11 arranged perpendicular to the inclined travel path. This particular position is important to subsequent door closure if the inclined travel path is linear. Further travel is unnecessary for full door opening and would result in the lowering of all higher panels 7, 8, 9, 10, 11. Accordingly, initiating closure would require that all such panels be raised in order for panel 12 to rotate for descent. Depending upon relative panel weights, this condition could prevent door closure under gravity forces as desired. Provisions to eliminate this situation when necessary will be discussed later. A mechanical lock to be discussed is used to hold the door in this opened position. The dynamic counterweight system used to cause door closing as well as opening will be discussed later. The actual devices used to achieve this operating scheme will be discussed in the following paragraphs.

The travel direction of the door guide rollers and partial support of the door panels illustrated in FIG. 2 are provided in the embodiment of the invention by roller guide side rails mounted to either side of the door 1.

FIG. 3 illustrates the installed right hand roller guide side rail. The roller guide side rail is constructed of a lower vertical section and an upper section containing a diagonal as well as vertical guide rail segments. This sectioning facilitates transportation as well as guide rail erection and door placement. Regarding the latter, the upper sections of the guide rails are placed first, the door assembled and panels fed upward into the upper sections and then the lower sections of the guide rails installed. Each lower guide rail section consists of a roller guide rail as common to conventional overhead doors 13, a back plate 15 for mounting the guide rail on the door jamb and a roller latching device to hold the door in its closed configuration 20. A cable 21 is used to unlatch the device 20 from a remote position.

The upper guide rail section consists of a dual-pathed conventional overhead door roller guide 14, a back plate 19 for mounting the guide rail on the exterior wall 4, fixture plates 16, 17, 18 for securing the guide rail 14 to the side wall of the overhead cabinet 5, a deflector cam 25 mounted on the back plate 19 and a roller intercept 26 for the purpose of deflecting alternate panel rollers up the inclined section of the upper roller guide rail section 14, and a latching device 22 for securing the door in its full open position. The illustrated latching device 22 is activated by displacement of a cable 23 directed as required by a small sheave 24.

Alternately, the door can be fixed in its full open position by locking the traveling counterweight support system as will be discussed later. The lateral spacing provided between the upright elements of the upper roller guide section 19, 14 is carefully resolved to be restrictive on the rollers enough to preclude unwanted cocking in position of folded or collapsed door segments 7, 8, 9, 10 yet provide adequate clearance for roller rotation. The roller guide rail sections, of course, must be designed considering design critical roller constraint forces occurring in the operation of the particular door being served as well as the door geometry during the various stages of operation. The latter in many cases will be restrained by architectural features of the adjacent building area.

Figure 4:
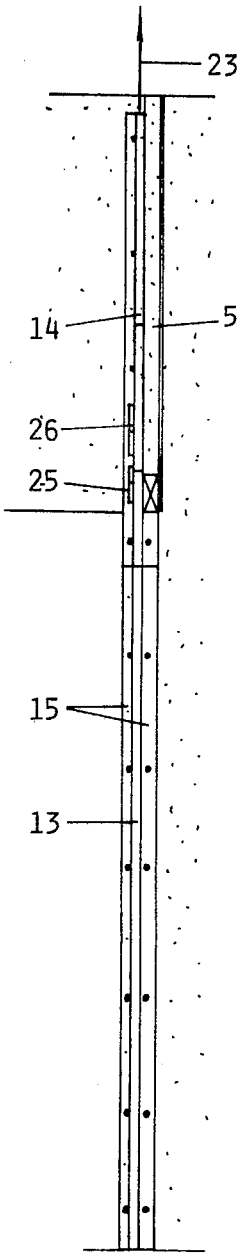
FIG. 4 is the end view of the erected side roller guide rail component of FIG. 3.

FIG. 4 is a side view of the roller guide side rail illustrated in FIG. 3. After the roller side guide rail system is installed, a sheet metal raceway 28 is placed over the guide rail sections visible from the enclosed buiding space. FIG. 5, 6, 7, 8, 9 illustrate details of the raceway 28.

FIG. 5 is an illustration of the rail guide system as viewed in FIG. 3 with the covering raceway 28 installed.

Figure 6:
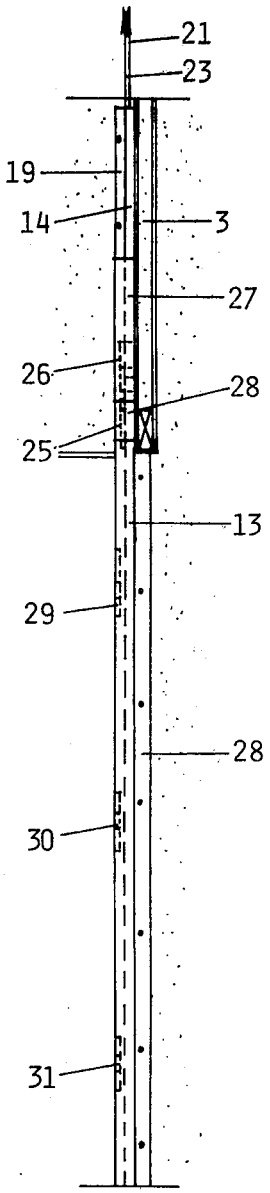
FIG. 6 is the end view of the completed side roller guide rail assembly of the invention as illustrated in FIG. 5.

FIG. 6 is an illustration of the rail guide system as viewed in FIG. 4 with the covering raceway 28 installed. The covering raceway functions to reduce any possible operational safety hazards, to enhance the appearance of the closure system, and to provide a mounting for cams 29, 30, 31 that cause the closed door to seat against the door jamb providing a weather tight seal. The raceway extends from floor level up to the lower edge of the panel cabinet 5. An extending plate 27 extends from this point along the underside of the diagonal roller guide component 14 for the full extent of the diagonal roller guide component 14. The extending plate 27 is preferably made as a fixed part of the upper roller guide section. As indicated in FIG. 6, the raceway is secured by lag screws to the door jamb.

FIG. 7 provides a cross-sectional view of the lower guide rail segment with the covering raceway installed. The view is designated as Section C—C in FIG. 5.

In FIG. 7 the solid lines designate the initially installed roller guide rail section 13, 15, 25; the dashed lines designate roller components 32 as equipped with stepped roller sub-components provided to engage the raceway mounted cams 29, 30, 31 as will be discussed using FIGS. 12, 13, 14, 15 and the hatched lines designate the raceway's cross-section.

FIG. 7 compliments FIGS. 5 and 6 in illustrating the positions of the sealing cams 29, 30, 31 as well as the role of the raceway in mounting same. The raceway is secured to the previously installed roller guide rail assembly by periodically spaced clips 33 and lag screws 34. As will be discussed in greater detail, the rollers 32 will engage the sealing cams 29, 30, 31 in the closed door configuration causing the cams 29, 30, 31 and, hence, the raceway 28 to exert lateral forces on the door through certain of the roller assemblies to affect weather tightness.

FIG. 8 provides the cross-sectional view of the upper roller guide rail section 19 designated as Section A—A in FIG. 5. As indicated, the raceway does not extend up along this vertical section. Also, as the figure implies, door rollers traversing this section are not equipped with additional stepped rollers as no lateral motion or deflection of rollers entering this region is necessary for panel collapse or folding.

FIG. 9 provides a cross-sectional view of the diagonal roller guide section as equipped with the cover plate 27 forming an upper extension of main raceway 28. The view is as denoted as Section B—B in FIG. 5. In this figure, the solid lines designate the diagonal roller guide rail section 14. The dashed lines designate the stepped roller equipped door roller assemblies 32 as attached to a door panel. All rollers entering diagonal guide rail section must have been deflected from the vertical travel path and are instrumental in the subsequent door sealing operation and, hence, must be equipped additionally with the indicated stepped rollers 32. The hatched lines indicate the cross-section of the guide rail covering plate 27 extending from the vertical raceway section. The plates bent edge provides necessary structural stiffening.

FIGS. 2, 3 illustrate the roles and positions respectively of the roller deflector cam 25 and intercept plate 26. FIGS. 10, 11 provide additional detail.

FIG. 10*a* provides a side view of these components as mounted in the roller guide rail assembly. The roller deflector cam 25 is attached to the mounting plate of the vertical upper guide rail section 19 and is positioned to engage and cause initial lateral deflection of the stepped rollers as mounted on alternate door roller shafts. This initial deflection causes the door lifting cable force to act through an eccentricity across the door panel juncture in the immediate vicinity thereby initiating a door panel buckling action promoting desired continuated roller lateral motion. The roller interceptor plate 26 then intercepts the now off-centered traveling roller completing its redirection up the diagonal roller guide section 14.

FIG. 10*b* provides a perspective of the interceptor plate assembly 26. The vertical surface of the interceptor plate 26C is attached to the vertical guide rail section 19, whereas the bottom inclined surface 26A is attached to the diagonal rail section 14. The inclined surface 26A is wider than the guide rails 14, 19 to allow projection into the vertical roller path. The projection is such that only stepped roller equipped roller assemblies are contacted and influenced. Accordingly, the projection of the lower plate 26A does not extend into the path of the supporting shaft of non-diverted rollers nor, due to its projection outside the channel of the vertical roller guide 19, does it interfer with the end main roller of non-diverted roller assemblies. A neophrene facing is applied to the face of the projection of the interceptor plate 26A to reduce friction and noise, as well as to place the top of the main end roller of the diverted roller assembly in the place of the inner surface of the upper curved section of the diagonal roller guide section 14.

FIG. 11 provides an end view of the overall assembly as side viewed in FIG. 10*a*.

FIG. 12, with one exception, illustrates the various roller door guide and support assemblies used in the embodiment of the invention. Omitted are the roller assemblies that are mounted at the extreme bottom of the door 1 to which the lifting cables 43, 44 are attached. FIGS. 15, 16 will be used to discuss these exceptions.

FIG. 12*a* illustrates the roller assembly used at the upper corners of the upper door panel 7. The guide roller 36 is mounted on a shaft 37 which is inturn attached to the door panel 7 through a steel mounting bracket 38. The steel angle 38*b* is centered relative to the width of the door panel. The length of the mounting bracket extension 38*a* is such that the horizontal projected separation distance between end rollers of the upper door panel 7 common to a guide rail system equals that of lower door panels 8, 9, 10 when these panels are in a folded translating or terminal position. FIG. 2*g* illustrates such a terminal position. The length of shaft 37 is such that main guide support roller 36 travels within the channel section of the roller guide rail 13, 19.

FIG. 12*b* illustrates the roller assembly used at other door panel junctures that translate vertically only. The mounting bracket is attached to the lower corner of the upper door panel. This roller assembly is similar in design to that of FIG. 12*a*. However, the length of the bracket extension 38*a* is dictated by panel joint geometry and the need to prevent the lower common panel from being pushed against the door jamb as the upper level is in a position of rotation away from the door. FIG. 13 provides additional details of this roller assembly.

FIG. 12*c* illustrates one of the three types of diversion roller assemblies used in the embodiment. The main guide roller 36 is supported by a shaft 37 rigidly attached to an angle mounting bracket attached, in turn, to the lower door corners of a door panel. The shaft 37 is panel edge centered and positioned as close to the bottom edge of the door panel as the recessed bracket thickness will allow. An additional dual radius roller 39 is positioned on the shaft 37 such that; despite possible lateral movement of the main roller 36 in the channel of the guide rail 13, 19; the larger radius roller segment 39*a* remains in the path of the deflector cam 25 and the smallest radius roller segment 39*b* remains in the path of the lower sealing cams 29, 30, 31. The dual radius roller 39 is free to rotate but held laterally by small slip rings. The position and radius of the larger roller segment 39*a* is such that in joint action with the deflector cam 25 and intercept plate 26 will divert the involved panel juncture as required for control by the diagonal guide rail section 14. The position and radius of the smaller roller section 39*b* is such that it will be intercepted only with the lowest sealing cam 31. The roller assembly of FIG. 12*d* varies in design from that of FIG. 12*c* only in the radius of the smaller section of the dual radius roller 41*b*. It is sized to allow passage of the upper sealing cam 29 but insure interception by the middle sealing cam 30. The roller assembly of FIG. 12*e* is also indentical in design with the roller assembly shown in FIG. 12*c* with the exception that the radius of the smaller section of the dual radius roller 42*b* is sized to insure interception with the upper sealing cam 29.

A weather seal insulating strip 59 is mounted on the bottom edge of the lowest door panel 12. If the thickness of this strip is large enough to prevent contact of the roller 36 with the floor, the roller assembly illustrated in FIG. 14 is used. A cable attachment 60 is mounted on and pivots about the roller support shaft 37. The shaft 37 is, in turn, firmly attached to the corner bracket 40. Should the thickness of the weather seal insulating strip 59 not be large enough to prevent contact of the roller 36 with the floor, the roller assembly illustrated in FIG. 15 is used. In this case, the main guide roller 36 must be attached at a greater distance above the bottom of door panel 12. The arrangement of FIG. 15 meets this need. In addition to providing vertical guidance lifting cable attachment 39, the assembly must prevent the bottom edge of the door panel 12 from laterally translating into the door jamb as the panel rotates during final closure or initial opening operations. Accordingly, two main guide rollers 45*c*, 45*d* are used to restrict angular motion roller/cable mounting post 45*a* while the latter is free to rotate about the pin 45*b* as firmly attached to the corner bracket 40. As the lifting cable 43 displaces, the roller assembly translates vertically with the lower edge of door panel 12 remaining free of the door jamb.

FIG. 16 illustrates the application of preceding guide/support roller assemblies as they are applied to the door 1 of the embodiment of the invention. The illustrated door consists of six panels 7, 8, 9, 10, 11, 12 jointed by hinges at their respective junctures arranged to permit panel folding as illustrated in FIG. 1. The lifting cables 43, 44 are attached to the roller/cable attachment assemblies 45, 46 which are in turn fixed to the bottom corners of panel 12. Accordingly, induced displacements of the lifting cables 43, 44 relate directly to panel motions. The roller/cable assemblies are of either of the type shown in FIG. 14 or 15, depending upon separation distance between the bottom of the lowest door panel 12 and the floor. Roller assemblies 47, 48 mounted to the top corners of panel 7 are non-diverting and of the design of FIG. 12*a*. In the folding or collapse of the door, the junctures of panel 7 and 8, 9 and 10 and 11 and 12 are caused to move laterally under the influence of the diagonal roller guide rail 14 as illustrated in FIG. 2. The roller assemblies supplied at these joints must act with the deflector cam 25 and intercept plate 26 in initiating lateral motion. Additionally, these roller assemblies must engage the sealing cams 29, 30, 31 when the door is in its down or closed configuration for the purpose of security and weather-tightness. Accordingly, the roller assemblies 53, 54 mounted to the bottom corners of panel 7, the roller assemblies 55, 56 mounted to the bottom corners of panel 9, and the roller assemblies 57, 58 mounted to the bottom corners of panel 11 are of the designs illustrated in FIG. 12*e*, 12*d*, 12*c* respectively. The juncture of panels 7, 8 as well as panels 10, 11 move only vertically and are equipped with non-diverting roller assemblies 53, 54, 57 and 58 of the design illustrated in FIG. 12*b*.

The cam arrangements for securing the door 1 in a weather-tight closed position are better illustrated in FIGS. 17, 18 and 19. FIG. 17 shows a partial front elevation of door 1 and roller guide rail raceway 28 as seen from the enclosed building space. The figures indicate the approximate positions of the sealing cams 29, 30, 32 as mounted on the interior of the raceway 28. Due to the directions of hinging, a lateral force applied at these cam positions against the junctures of panels 7 and 8, 9 and 10 and 11 and 12 respectively causes the perimeter of the closed door to be pressed against the door jamb/weather strip assembly. These lateral forces on the illustrated side of the door are caused by the sealing cams 29, 30, 31 engaging roller assemblies 54, 56 and 58 respectively as the door moves downward under the force of gravity into its closed configuration.

FIG. 18 provides side views of the seating engagement of cams with roller assemblies. FIG. 18 shows the engagement of roller assembly 54 with sealing cam 29. The smaller radius section 42*b* of the dual radius roller 42 is intercepted by the cam 29, directing the juncture of panel 7 and 8 in the desired lateral direction for sealing purposes. Simultaneously, the lower roller assemblies 56 and 58 are engaging cams 30 and 31 respectively.

FIG. 18*b* illustrates the engagement of the smaller radius roller segment 41*b* or roller assembly 56 with its cam 30.

FIG. 18*c* illustrates the engagement of the smaller radius roller segment 39*b* of roller assembly 58 with its cam 31. The cam engaging roller segments are aligned with the vertical axis of the sealing cams, however, are varied radii and the cams are varied projections such that no roller/cam contact occurs until the door is in its full down position and sealing achieved.

FIG. 19 is a front view of the components shown in a side view of FIG. 18*c* and provides additional details of component relative positioning.

Door latching assemblies are provided to lock the door in the open as well as closed position. Both latches are interconnected by cables 21, 23 to a common cable running to a common lock operation station mounted on the wall section to one side door. Similar locks on the other roller guide rail are likewise connected to the common lock operation station. The lock at the latter station is manually operable from either side of the wall section. Manipulation of the lock displaces the latching cables 21, 23 which, in turn, opens simultaneously the upper latch 22 and the lower latch 20. While not essential, both latches operate open simultaneously as a design simplification. Both roller guide rails are equipped with an upper and lower latch set. Both sets are interconnected to the common lock operation station. Hence, the cable displacement caused by the operator in manipulating the common lock simultaneously opens the latches of both guide rails as well as the upper and lower latches of each rail.

Alternately, the door latching assemblies may consist of standard mechanical latches placed at the upper and lower operating limits of the traveling counterweight. For example, latch assembly 22 may be replaced by a mechanical latch that is mounted at the base of the counterweight raceway and engages the weight segment platform once the counterweight has reached its lowest position and, hence, the door reached its full open position. Latching cables and lock accessories would be used as described above. Remote control of latch operations is possible through the use of solenoid assemblies mounted in line with the main cables.

FIG. 20 provides a side view of the upper roller guide rail section 19 serving the right hand side of the door 1 as viewed from the interior space. The upper latch assembly 22 consists of a plate appearing in geometry as a segment of a circle 22*b* connected at its base by a pin 22*c* to the flat leg of the channel of the roller guide rail 19. Under the action of the upper spring 22*e*, the plate tends to rotate about the pin through a slot placed in the guide rail 19 into the rail channel and, hence, the path of the guide rollers. The latching cable 23 acts to withdraw the plate from the rail channel and, hence, unblock the path of the guide rollers.

The angular plate 22*b* is equipped with an edge plate 22*d* of slightly smaller width than that of the rail entry slot for the purpose of proper roller support both during desired roller passage and during the latching of door 1 as achieved by placing the plate 22*b* in an inserted position immediately beneath a main guide roller 51. The positioning of the latch assembly 22 and the integrated use of the structural bar 22*a* allows the latch to close under the action of the spring 22*e* only when the panels are in their final open configuration or have cleared the upper roller guide region and are being lowered for door closure. The latch stop 22*f* checks the outward motion of the plate 22*b* once the linear edge plate 22*d* becomes flush with the inner surface of the rail guide channel. Hence, proper roller support or restraint is provided during desired roller passage.

As will be illustrated in FIGS. 25 and 26, there is only one panel configuration in the vicinity of the upper latch 22 that involves no roller restraint against the inward rotation of the latch plate 22*b* and, thereby, allows latching. The one panel configuration is that of the desired full open position of the door 1. The center of radius of the latch plate 22*b* is offset from the path of the roller such that the contact force exerted through the roller 51 will not induce latch plate 22*b* rotation. The top surface of the plate 22*b* as equipped with the edge plate 22*d* is circular such that clockwise rotation of the latch plate 22*b* induced by displacement of the latch cable 23 does not require the uplifting of the roller 51. The projection of the angled bar 22*a* above the roller 51 acts with certain counterweight system devices to insure the roller 51 and, hence, the folded door does not proceed beyond the intended full open position. Surface of the latching assembly 22 in periodic contact with rollers may be covered with neophrene to minimize noise.

FIG. 21 provides an end view of the upper latch assembly as illustrated in FIG. 20.

FIG. 22 illustrates the lower guide rail latching assembly 20. The lowerst roller of the door 1 is engaged by this latch when the door 1 is fully closed. The beveled top latch plate 20*a* is attached by pin connection 20*c* to a mounting plate 20*b*. The mounting plate is welded to the base of the guide rail section 13 in position external to the rail's channel. Hence, the roller shaft 35 and not the roller engages the beveled top of the latch plate 20*a* causing it to deflect laterally and the shaft 35 to enter the latch's chamber. A tension spring 20*d* is connected between the left top projection of the latching plate 20*a* and a pin 20*e* at the base of the mounting plate 20*b*. It serves in conjunction with a post stop 20*f* to keep the latch plate 20*a* in the vertical orientation except where the latter is deflecting under temporary engagement with the roller shaft 35.

FIG. 23 provides an end view of that illustrated in FIG. 22 showing the position of the lower latch assembly relative to the channel of the guide rail 13.

FIGS. 24, 25, 26 illustrates various operational positions of the embodiment of the invention. They relate to the operational sequence schematics provided in FIGS. 2*b*, 2*f*, 2*g* respectively. As will be later clarified during discussion of the motivating counterweight system, the door operates in either of several general opening/closing operating modes.

First, assume the counterweight system is tailored to lifting load (including mass) demands exclusive of friction losses. Then the operator must apply a relatively small force to achieve closure as well as opening. Second, assume the counterweight system is tailored to lifting load demands including frictional losses associated with opening. In this case, the door would open automatically upon release but require operator manual effort to overcome downward frictional losses as well as to compensate for counterweight imbalances provided to overcome friction and achieve automatic opening. Third, assume the counterweight system is tailored to operating load demands including frictional losses associated with the closing operation. In this case, the door 1 would automatically close upon latch release but require operator manual effort during the opening operation. Finally, external energy such as electric power can be used to compensate for counterweight system energy losses and any variations between counterweight as provided and operating load demands. Consequently, the door's operation would be fully automatic.

As will be discussed, this external energy can be applied in the form of certain counterweight adjustments made between closing and opening sequences. As such, the energy can be applied at a low rate independent of the desired door operating rate and, hence, the power demand can be minimized. With the mid-cycle adjustment made, the door is readied for automatic opening or closing upon latch release with such actions requiring only internal counterweight forces. Alternately, of course, the external energy can be applied during either one or both of the operation cycle phases, opening and closing. In these cases, however, the required power rate depends upon the desired door operating rate. As will be discussed later, the operation of the door is never firmly fixed to the operation of the external energy source. Manual effort may control at any time. Secondly, due to the use of a dynamic counterweighting system, manual emergency stop is feasible.

In FIG. 24, the door 1 is in its closed and downward locked position. The counterweight system is maintaining the tension in the lifting cable 43 either completely adequate or adequate when supplemented by moderate manual uplifting effort to initially accelerate the door, and through subsequent enroute adjustment, to achieve full opening upon release of the latch 20. The counterweights are at their highest position ready for descent. In this position, the sealing cams 29, 30, 31 are pressing against adjoining roller assemblies 53, 55 and 57 in acting to maintain weather tightness.

In FIG. 25, the door is an intermediate state of opening. The roller assembly 55 has been engaged and deflected by the deflector cam 25. The increasing eccentricity produced between the juncture of panels 9 and 10 and the line of action of the lifting cable 43 is continuing to promote folding of panels 9, 10 and, hence, the collapse of the door 1. As the lower roller assembly 55 of panel 9 ascends the diagonal roller guide rail 14, the angle subtended by panel 9 and the vertical roller rail guide sections 19 increases from zero to either 90 degrees or something near 90 degrees if panels are not to completely collapse and come into mutual surface contact. As this angle increases from zero to nearly 45°, the center of mass of panel 9 and all those above it 7, 8 is rising; however, rising at a reducing rate. At approximately the 45 degree value, the mass centers are instantaneously at rest and, then, begin accelerating downward until the roller assembly reaches the upper end of the diagonal rail guide 14 and begins again to translate vertically.

As the roller assembly 55 begins to translate vertically, panel 9 and all those above it 7, 8 accelerate upward again. This motion reversal is repeated each time adjoining panels go through the folding action during the overall closing as well as opening of the door 1. Such repeated motion reversals are objectionable as they complicate counterweighting and result in structural stress conditions detrimental to the door structure and durability. An optional embodiment of the diagonal roller guide rail is illustrated in FIG. 27 that eliminates or greatly reduces such reversals in panel motion. The upper latch 22 is being held open by passing rollers.

FIG. 26 illustrates the full open configuration of the door 1. Note that all but the lower two panels 11, 12 have folded completely and that the upper latch 22 has now closed as roller constraint has been removed. The latter panels have reached a partial fold position at which any additional folding would result in the upper panels 7, 8, 9, 10 which have just reached a position of rest again accelerating upwards. Leaving these two panels 11, 12 in this partial fold position negates this last motion reversal and, most importantly, allows closure to begin under the influence of gravity once the upper latch 22 has been released without necessitating the raising of all upper panels 7, 8, 9, 10. Such initiation of closure would be impossible if the potential energy loss of the lower two panels 11, 12 did not exceed frictional loss and the potential energy gained by the upper panels 7, 8, 9, 10 in raising until the lower panel 11 reached the 45 degree angle position described above. The relative weights of the lower panels 11, 12 could be increased to alleviate this starting condition. The upper panels 7, 8, 9, 10 are shown in a completely folded configuration. Possible rotation of these panels and, hence, roller reactive forces relate to the lateral restraint on roller motion, panel weight, the distance between rollers on opposing panel sides, panel thickness and the angle subtended by lines connecting the axis of the roller shafts 37 assemblies 53, 49 and 55 or of roller assemblies 49, 55 and 51. Usually, these angles are equal. Note that even though the surfaces of adjacent panels are in contact, the angle described above is non zero. This angle is of prime importance to the structural integrity and operation of a door system of any particular panel geometry and weight. Reducing this angle results in greater reactive moments that must be applied across panel rollers to maintain a particular panel fold geometry.

Considering the design parameters that influence reactive roller restraint forces, increasing this angle by increasing the end roller separation distance relative to the spacing of vertical guide rails may be significantly beneficial despite the fact that, in terminal folded configuration, connecting panels may not be in a surface contacting horizontal position. Significant improvements in this regard are possible in such cases with only minor increases in overall folded panel assembly stacking heights. The heights of the vertical rail sections need only to extend approximately to the top of the upper panel 7 as positioned in FIG. 26.

Further efficiency is possible if the roller assembly 57 of panel 11 is mounted in the center of panel 11. In this case, the folding of panels 11 and 12 require significantly less work as the upward displacement of the other panels is greatly reduced. The magnitude of counterweight is reduced and smoother operation achieved. The unfolding of panels 11 and 12 is also enhanced as the weight of these panels act more efficiently in descending with the changed geometry. Panel 12 can be easily placed, at closure, in a horizontal position more neatly closing the bottom opening of the collapsed panel enclosure cabinet. Also of importance, the overall height of the upper rail section is significantly reduced.

The embodiment improvement involving the use of a partially angular diagonal guide rail 14 as discussed above is illustrated in FIG. 27. The intermediate door operating configuration of FIG. 25 is used in the illustration. Note that the upper section of the diagonal roller guide rail section 14 has been converted to a circular segment from the point at which the upper inclined panel 9 is sloped at a 45 degree angle with the horizontal to the point at which the diagonal roller guide rail 14 transitions to a vertical rail section. The radius of the circular section measured to its geometric centerline equals the radius of rotation of panel 9 measured from its hinged juncture with the upper panel 8 to the shaft axis of roller assembly 55 or, according to particular design, the radius of rotation of panel 7 measured from the shaft axis of roller 47 to shaft axis of roller 53.

Under the restraint of the curved guide rail section, the upper inclined panel 9 rotates into a horizontal position 9× without requiring the displacement of the upper panels 7, 8. Hence, during door opening or closing, no intermittent reversal in panel motion direction occurs. However, the motion of upper panels 7, 8 is momentarily arrested as the supporting inclined lower segment 9 negotiates the curved section of the diagonal rail guide section 14. The more complete collapse of the bottom two panels 11, 12 can now be achieved, if desired, without the difficulty of initially raising the upper panels 7, 8, 9, 10 in order begin descent of the lowest two panels 11, 12.

Further refinement is possible by curving downward of the lower end of the diagonal rail guide section 14 in order that the diverting rollers 53, 55, 57 transition more smoothly from the vertical to the inclined guided direction. Of course, duplicate modification would be made to the other upper rail guide for the more smooth deflection of diverting rollers 54, 56, 58.

A variable counterweight system is used to operate the preceding closure system. The design is an embodiment of inventions described in the referenced patent application. In the referenced pending application, a counterweight composed of weight components is connected to a movable load which exerts varying static and dynamic forces requiring counteracting with a minimum input of energy into the system. The force counteracting effectiveness of the counterweight components which may be individually arrested during movement of the load. In the case of this invention, the movable load is the door 1.

The referenced invention also addresses the same problem of counteracting static and dynamic forces exerted by a movable load through further development of the counterweight to enable it to counteract the load exerted in a finer degree during movements of the load. This increased force counteracting ability of the counterweight in the referenced invention is achieved by dividing the counterweight into two groups of weight components, and making provision for lifting components of the second group a limited amount relative to components of the first counterweight group when the counterweight is at its lowest position.

For this design of the counterweight system, there are several parameters permitting the adaption of any desired motion, such as the number of partial weights of the two groups, the weight (masses) of the partial weights, the locations where the stop means for the partial weights of both groups are mounted and the distances by which the partial weights of the second group are raised.

The partial weights of the first group being mounted one on top of the other and cooperating with the fixed stop means, one preferred embodiment of the referenced invention so designs the second group of partial weights that at least a few partial weights of the first group are sub-divided into two parts which may move relative to each other in the vertical direction and are mounted one above the other, and in that provision is made for a support connected with the lifting system for each upper part and displaceable by a limited amount in height.

In this case, the lifting system for the supports of the upper parts are designed in such a manner it raises these supports sequentially by that limited height. This design allows raising the partial weights of the second group which rest on these supports, with very small forces and accordingly low power. Alternately, a system is designed to raise these supports simultaneously by that limited height. This design allows raising the partial weights of the second group which rest on these supports with small but larger forces over a shorter time period.

The counterweight system of this invention is an embodiment of referenced invention. In the preferred embodiment of this invention, the geometry of the counterweight system is further resolved to be accommodated within the stud wall space of a wood frame building common to residential house construction. Hence, its depth is limited to that of the stud depth. Its height ranges between the top and bottom wood plates of the wall framing. Its width is approximately that of common wall stud spacing although a wider space would present no problem. An access panel covers the counterweight system on the interior side and conventional sheathing and exterior siding covers on the exterior side. Since the system is relatively maintenance free, regular interior wall covering such as gypsum board may extend over and completely conceal the counterweight system.

In this embodiment, the variable counterweight system is used to dynamically as well as statically tailor motivating forces to the non-linear forces demands of the moving door. The system allows control of the door's opening and closing accelerations and velocities. Through far more effective counterweighting than conventional systems provide, more efficient manual operation is allowed. Basically, input manual effort is reduced to that necessary to overcome friction energy losses. As previously discussed, far more flexible manual operating modes are provided. For example, the door can be made to self-open or self-close with manual effort expended only during the subsequent closing or opening sequence respectively.

Additionally, the counterweight system also allows complete automation. During the opening sequence, the counterweight segments are designed to be successively picked off the downward traveling counterweight platform by wall mounted support projections. The effective counterweight (mass) remaining after each pick off action is that required, considering desired door opening accelerations and/or velocities, for the travel period until the next counterweight reduction is made in the same manner. Hence, successive incremental counterweight adjustments are provided as required to maintain desired door opening motions. In order that the door close automatically upon lower latch 20 release, additional external work must be done to compensate for such variances such as frictional losses. Accordingly, a limit switch is enacted by full door opening that causes certain weight components of the vertically arrayed counterweight system to be moved upwards by a certain amount such that the resulting counterweight force becomes tailored to closing door demands considering such variances as continued frictional losses. An electric motor is used to produce the low level of power required. Upon upper latch 26 release the door closes in the desired manner. Accordingly, neither opening nor the closing of the door occurs necessarily during the input of required external energy nor is directly linked to the power source.

Emergency door arrest may be manually achieved with moderate effort due to the dynamic nature of the counterweighting and the absence of direct linkage to the external power source. Complete manual operation of an automatic system is possible without any system adjustment.

The preferred embodiment of this invention is illustrated in front view of FIG. 28. The counterweight G acting on cable 43 is subdivided into four partial weights 64, 65, 66, 67 and a weight support platform 68. The transverse dimensions of the partial weights are different, so that each upper weight 64, 65, 66 projects somewhat on the sides beyond the partial weight 65, 66, 67 respectively immediately below it. The weight support platform 68 is suspended from cable 43, while the other partial weights 64, 65, 66 and 67 can glide with respect to the cable 43.

A guideway for the partial weights and support platform consists of two conventional overhead door roller guide rail sections 61*a* and 62*a* mounted by brackets 61*b*, 62*b*, 61*c*, 62*c*, 61*d*, 62*d*, 61*e*, 62*e* to the wall studs 64', 65'. The rail sections are equipped with projections 69, 70; 71, 72 and 73, 74 at different elevations, which protrude by different amounts into the paths of the motion of the partial weights, whereby projections 69, 70 retain the first partial weight 64; projections 71, 72 the partial weight 65; and projections 73, 74 the partial weight 66. The traveling support platform 68 supports the lowermost partial weight 67.

Several of the partial weights always are subdivided into two parts each which can be displaced relative to each other in the vertical direction, and devices are provided to raise the upper part with respect to the lower part by a limited distance. Illustratively, the partial weights 64, 65, 66, and the support platform 68/lowermost weight 67 combination are subdivided in this manner. The support platform 68 is solidly connected to the cable 43, while the supported weight 67 can glide with respect to cable 43. Similarly, the partial weight 66 is subdivided into two parts 66*a*, 66*b*; the partial weight 65 into two parts 65*a*, 65*b*; and the upper most partial weight 64 into two parts 64*a*, 64*b*. The upper parts 64*a*, 65*a*, 66*a* and 67 are combined with a system of vertical rods 76, 77, 78, 79, 80, 81 and lifting cables 82 to form a lifting frame such that the upper parts 64*a*, 65*a*, 66*a* and 67 are displaceable along a limited vertical distance. The upper parts may consist of weight supported by a separate plate, the latter being connected to the rods.

The top view of upper weight part 64*a* is illustrated in FIG. 29*a*. The centered hole accommodates through gliding of the main lifting cable 43. The mounted directional pulleys 84*a*, 84*b* accommodate the upper weight part lifting cable 82. The holes in each of the outermost corners are threaded for the connection of four support rods 76, 77. The end cutouts allow free travel of the weight part 64*a* along the guide rails.

FIG. 29*b* illustrates the upper weight part 65*a*. A centered hole is provided for the passage of the main lifting cable 43. The outermost hole at each of the four corners are sized to permit the unrestricted passage of the penetrating support rods 76, 77 secured at their top ends to upper weight part 64*a*. The innermost holes at each of the four corners of part 64*a* are threaded for the firm attachment of four lower support rods 78, 79. The lateral dimensions of the end cutouts are such that the weight part 65*a* can freely pass the part support projections 69, 70.

FIG. 29*c* illustrates the top view of upper weight part 66*a*. A centered hole is provided for the passage of the main lifting cable 43. The outermost hole at each of the four corners are sized to permit the unrestricted passage of the penetrating support rods 78, 79 secured at their top ends to upper weight part 65*a*. The innermost holes at each of the four corners of part 66*a* are threaded for the firm attachment of four lower support rods 80, 81. Lateral part dimensions are such that upper support rods 76, 77 can freely pass the part 66*a* location and the part 66*a* can freely pass the upper part support projections 69, 70, 71, 72.

FIG. 29*d* illustrates the top view of weight part 67. A centered hole accommodates through gliding of the main lifting cable 43. The holes at each of the four corners permit free passage of the penetrating support rods 80, 81.

FIG. 29*e* illustrates the lower weight parts 64*b*, 65*b* and 66*b*. Lateral dimensions of these parts are such that they are intercepted and supported by support projections 69, 70; 71, 72; and 73, 74 respectively during downward counterweight G travel. As such, the lateral dimensions of part 65*b* are small enough to permit passage by this part of support projections 69, 70. The lateral dimensions of part 66*b* are small enough to permit passage by this part of support projections 69, 70, 71, 72. Weight part 67*b* remains supported by the lowermost counterweight element, the support plateform 68. As such, it serves to allow counterweight increases through the supplement of the constant support platform weight.

Returning to FIG. 28, the illustration indicates the use of the corner circular rod 76, 77 to interconnect weight parts 64*a* and 65*a*. The upper rod ends are threaded into part 64*a* but the lower ends glide through holes in the corners of the lower part 65*a*. The lower interconnections of weight parts and support rods are similar. The rods are offset in vertical alignment to accommodate subsequent upward collapse of the counterweight G. Nuts threaded on the lower rod ends allow the rods and, hence the upper weight parts to support the lower parts during displacement of the lifting cable 82.

As shown in FIG. 28, the upper weight parts 64*a*, 65*a*, 66*a* and 67 are supported by the lower weight parts 64*b*, 65*b*, 66*b* and support platform 67 respectively during the downward motion of the counterweight. As will be shown below with the door 1 locked in its open position, the external energy source is used to retract the cable 82 which, inturn, lifts upper weight part 64*a* through the constraint of connecting support rods 76, 77, 78, 79, 80, 81 which causes simultaneous lifting by the same amount of the upper weight parts 65*a*, 66*a*, 67.

With the counterweight G so adjusted, the door is ready for automatic closure upon release by the upper latch 22. Adjustments in support rod lengths can be used to cause upper weight parts to lift by unequal amounts if desired.

Returning to FIG. 28, the illustrated arrangement allows three adjustments or four counterweight magnitudes to be used. As will be clarified more below, if the rods are shortened such that when the support platform has been fully lowered, the parts 65*a*, 66*a*, 67 are instead suspended by the rods above parts 65*b*, 66*b* and the support platform 68 respectively, six adjustments or seven counterweight magnitudes can be used.

The displacements of the upper parts 64*a*, 65*a*, 66*a*, 67 take place in a manner to be discussed more closely below: the means of the lifting cable 82 passing from a support point on the upper framing plates 63 and guided over direction-changing rollers 84*a*, 84*b*, 84*c* to an electric motor not shown, so that the parts can be raised by motor but be free to be lowered under gravity. A compression spring with rubber bumber stop 85, 86 is provided at the top and bottom of the counterweight raceway for shock absorbing purposes during the completion of door opening and closing sequences.

An enlarged side view of the support platform is provided in FIG. 30. The rollers 68*d*, 68*e*, 68*f*, 68*g*, 68*h*, 68*i*, 68*j*, 68*k* are provided to prevent rotation or other malalignment of the support platform 68. The rollers are positioned within the guide rails 61*a*, 62*a*. The upper plate 68*a* provides a stable seating platform for the weight parts. A cable lock 68*c* fixes the support platform 68 to the cable 43 at the position where the cable 43 penetrates the upper plate 68*a*.

FIG. 31 provides a top view of the support platform 68 as side viewed in FIG. 30. An end view is illustrated in FIG. 32. Rollers 68*h* and 68*j* are placed on opposite sides of the vertical plate 68*b* in the interest of alignment.

After the door has been released and opens under the influence of the counterweight G, the weights are in the configuration of FIG. 28 unless the greater number of weight increments are desired. As this configuration is reached, a limit switch activates the electric motor not shown which retracts cable 82, which in turn, lifts the upper plate parts 64*a*, 65*a*, 66*a* and 67 by the amount Δ with the assistance of the support rods 76, 77, 78, 79, 80, 81. The lift magnitude Δ is determined such that the resulting effective counterweight-travel distance profile will result in the closure of the door as desired once the upper latch 22 is opened. A shock absorbing spring with rubber stop block 86 can be provided to properly terminate counterweight motion once the door has closed in proper position.

FIG. 34 illustrates the configuration of the counterweight G upon door closure. Once the lower door latch 20 is opened, the counterweight will lower and, in the process, cause the door to open as required. As noted, the support rods 76, 77, 78, 79, 80, 81 are arranged such that they do not interfere with the collection and collapse of counterweight parts.

If completely manual operations are desired, the intermediate weight part lifting is not accomplished as described above. Counterweight variances such as those related to frictional losses constitute the external energy demands that may be manually applied by the operator.

As mentioned above, the embodiment illustrated in FIG. 28 through 34 can be revised to provide six counterweight adjustment stations and, hence, seven different counterweight magnitudes during the counterweight travel. More refined counterweight tailoring would result. FIG. 35 illustrates.

As indicated, the weight segment 64 is first intercepted by support projections 69, 70. The lower support rods 76, 77 are designed less in length than the distance between support projections 69, 70 and 71, 72. Hence, as counterweight lowering progresses, the upper weight part 65*a* is next intercepted by the nuts attached to the lower end of support rod 76, 77; the latter are, inturn, supported by the arrested upper weight part 64*a*. As counterweight motion continues, the lower weight part 65*b* is next intercepted by support projections 71, 72. In a similar manner using deliberately shortened lengths of lower support rods 78, 79 and 80, 81; continued counterweight motion will result in the successive arrest of weight parts 66*a*, 66*b*, and 67. For automatic operations, the external power source would be applied upon full opening of the door 1 and all upper weight parts 64*a*, 65*a*, 66*a* and 67 raised a small equal amount. The counterweight system would, then, be tailored for automatic closing upon upper door latch release.

For manual operations, operator manual effort could alternately be used to apply that required external energy input described above. This energy could be applied by winch or by force applied by the operator directly to the door 1. Again, the counterweight could be designed such that this manual effort was necessary only during door opening or closing.

FIG. 36 illustrates the effective counterweighting force variations with door travel distance produced by the embodiment illustrated in FIG. 28, the embodiment of FIG. 28 as adjusted by intermediate application of external energy for return travel, illustrated in FIG. 33, and the revised embodiment illustrated in FIG. 35. Many other counterweight force variations are possible through the use of the invention as illustrated in these embodiments and those of the referenced patent application.

Figure 36A:
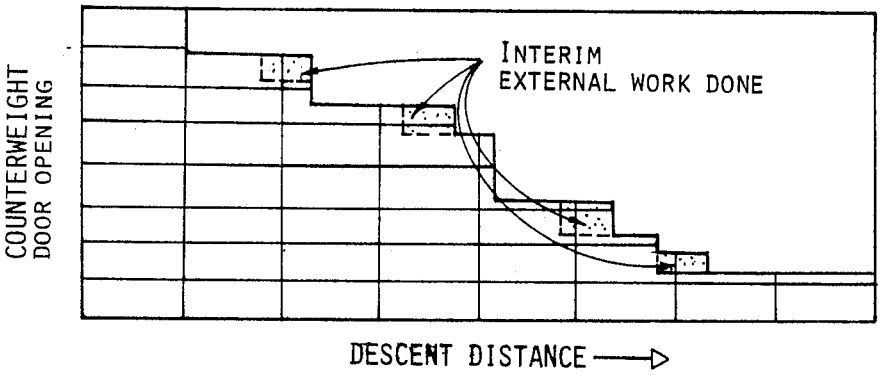
Figure 36B:
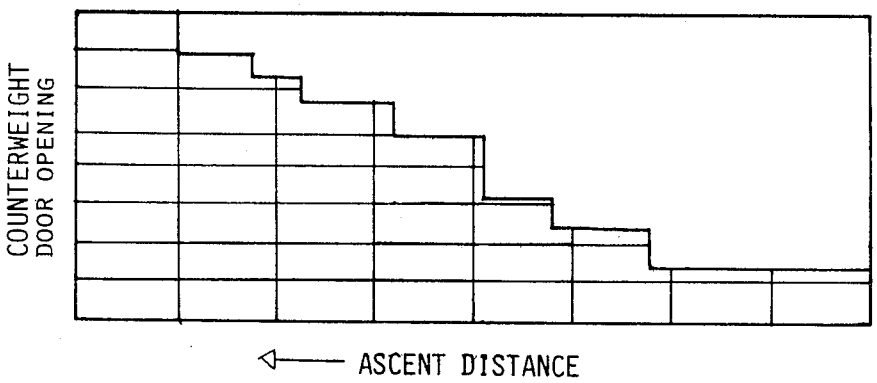
Figure 36C:
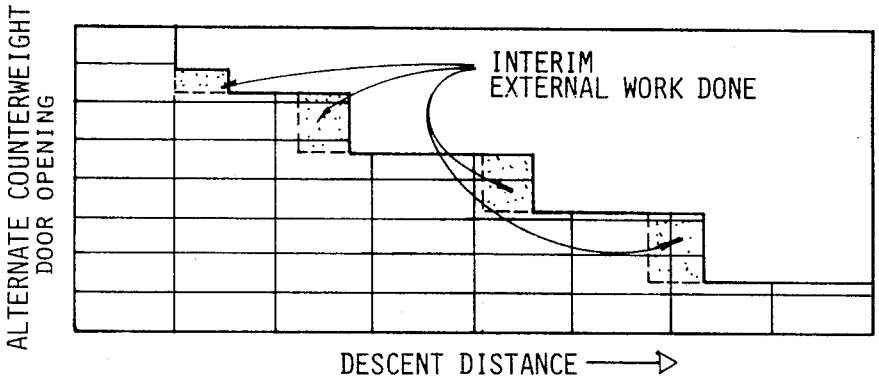
Figure 36D:
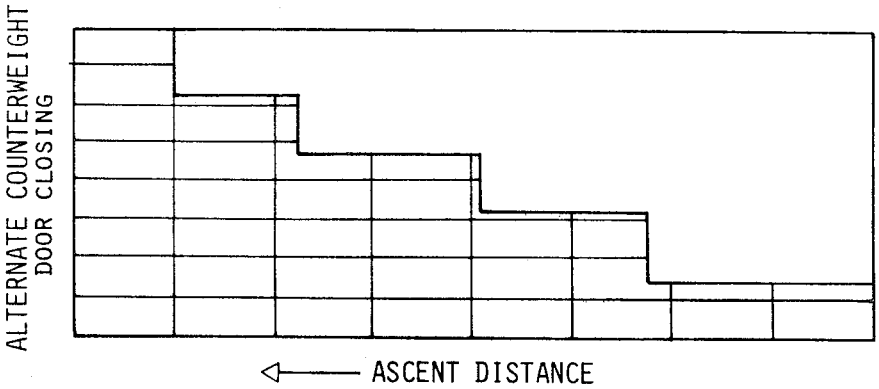

FIG. 36*a* illustrates the counterweight variations produced by the embodiment of FIG. 28 during counterweight descent. FIG. 36*b* illustrates the counterweight force variations produced by interim counterweight adjustments illustrated in FIG. 33 and desired during counterweight ascent. FIG. 36*c* illustrates the counterweight force variations produced by the revised embodiment of FIG. 35 during counterweight descent. FIG. 36*d* illustrates the counterweight force variations produced by interim counterweight adjustments as desired during counterweight descent.

FIG. 35 illustrates the supplementing of counterweight support projections 69, 70; 71,72; and 73,74 with support rods 76,77; 78,79; and 80,81 to provide additional counterweight adjustment stations. In this case, six stations and, hence, seven different counterweight magnitudes were provided during the counterweight travel. Of course, the number of counterweight adjustment stations can also be achieved by increasing the number of support projections, leaving the support rods the exclusive task of applying required external energy between closure opening and closing operations. FIG. 37 illustrates one of the many possible structural schemes. FIG. 37*a* shows partial view of the front elevation of the counterweight system in its lowest configuration. Support projection 69, 70 is shown as it functions to arrest the motion of weight part 64*b*. The additional elements of the scheme are the differently configured support projection 86 and the weight part 85*b* of same overall platform as the lower weight part 64*b* however with side lugs 85*a* added to allow interception by support projection 86. The support projection 86 does not project into the path of the lower weight part 64*b* nor interfere with the guide roller 36 and associated shaft 37 of any weight part.

FIG. 38 involves the roller guide rails and diversion guide rollers. FIG. 3 illustrated a roller guide rail system consisting of linear segments. A deflector cam 25 and intercept plate 26 were used to cause the diversion rollers to deflect and move from the vertical guide rail 13 up along the diagonal guide rail 14. FIG. 27 was used to illustrate certain performance improvements possible by curving the diagonal guide rail segment 14. The deflector cam 25 and intercept plate 26 were retained. The system illustrated in FIG. 38 provides an alternate to the latter. As shown, a dual channel guide rail is provided along the desired path of the diversion guide rollers. Section A—A shows a cross-section of the dual channel guide rail 87. One channel is provided to guide the main guide roller 36 as previously discussed. However, a second inner channel has been added to guide the main guide roller 36 in the absence of the constraint by the larger channel. Such a situation occurs at the location of desired diversion. As an extension of the main guide roller axle 37, a smaller secondary roller 88 tracks within the inner channel causing the desired smooth redirection of the diversion roller. This refinement reduces energy losses, wear and operating noise as well as accounts for smoother door motion.

The above dual tracked guide rail roller guide provides an alternative to the integrated deflector cam 25 and interceptor place 26 system as a means to initiate panel folding. FIGS. 40 and 41 illustrate still another alternate involving panel joint rotational forces (moments) mechanically induced and maintained in the portion of the door section within the constraints of the lower roller guide rails. Small lifting cable guide sheaves 90 are added to the upper edge of both ends of each door panel. As will be illustrated, on alternate panels, these small diameter cable sheaves 90 are attached to the upper corner of the panel's side edge adjoining the door jamb. For the other panels, the cable sheaves are made integral with the roller assemblies 47,48; 49,50; and 51,52. FIG. 40*a* illustrates the addition of the cable sheave 90 to roller assembly 47. FIG. 40*b* illustrates such addition as applied to roller assemblies 49 and 51. Modified roller assemblies 48, 50 and 52 for the opposite end of the door assembly are mirror images. In these cases, the cable sheave is attached to the side edge of the panel end away from the door jamb. FIG. 41 illustrates the integrated system and its functioning. FIG. 41*a* shows an end perspective of the door system in its closed configuration. The dashed line 6 represents the roller guide rail channel as they are located to each side of the door panels. Guide roller assemblies 91, 92 and 93 are the guide roller assemblies 47, 49 and 51 respectively, modified with cable sheaves as illustrated in FIG. 4*d*. Cable sheaves 90 have also been added to the upper corners of panels 8, 10 and 12; however, to the opposite side of the door's edge. Hence, on both sides of the door, the lifting cables 43, 44 assume a "zig-zag" pattern in the plane of the vertical door edge as the lifting cables 43, 44 extend from the bottom of the door to the overhead cable directional sheaves. The illustrated sheave 90 is to the right side of the door as viewed from the front. When tensioned by the counterweight, the cables tend to straighten, inducing joint rotational forces (moments) across each longitudinal panel joint. During travel through the lower guide rail 13, the guide rail channel prevents lateral joint motion that would otherwise relieve the joint moment induced by the "zig-zag" pattern. Joint moments due to the lifting cable's sheave interaction act in the same direction across alternate panel joints. Their direction is opposite across the other panel joints. Joints of panels 11, 12; 9, 10; and 7, 8 tend to move laterally to the side of the diversion while the other joints tend to move in the opposite lateral direction. During door raising, such joint rotational forces are sequentially eliminated as rotational constraint on each longitudinal panel joint is released as the diversion roller at that joint reaches the vertical/diagonal guide rail juncture and the particular roller is free to travel up the diagonal guide rail and motivated to do so by the relieving rotational force. FIG. 41*b* illustrates this action. As shown, the longitudinal joint of panels 7 and 8 has passed through the juncture and, under the constraint of guide roller assembly 53 is traveling up the inclined guide rail. The longitudinal joints of lower vertical panels remain under the influence of rotational moments but are still restrained from relieving lateral motion by the lower guide rail. Continued raising of the door is accompanied by subsequent similar lateral motion of the following diversion guide rollers, likewise induced by joint moments. During their travel through the lower guide rail 13, there is also a rotational force acting at the alternate longitudinal panel joints which are to travel only vertically. However, these rotational forces act opposite to those of the diverting panel joints and can cause no lateral deflection of the involved joints as the face of the vertical rail adjacent to the door jamb runs continuously in the vertical direction. These rotational forces are progressively eliminated as adjacent diversion roller panel joints reach the vertical/diagonal guide rail juncture and begin motion along the diagonal guide rail. In the preceding manner, door panel folding can be achieved without the use of deflecting cams 25 or dual tracked guide rail system previously discussed. All roller guide rail sections would be single tracked and without attached roller deflecting devices. The lowering of the door would involve the reverse of the preceding actions. As the diversion rollers of a particular joint would progress down the diagonal guide rail and into the channel of the lower vertical guide rail, the provided mechanical means would act to restore longitudinal joint rotational forces that had initiated roller diversion during the door opening phase, and restore as well rotational moments that act at neighboring joints but in the opposite rotational direction. This action would reduce the forces by which the unfolding panels impact on the door jamb as they reach a vertical configuration.

There are many means by which the preceding joint rotational moments can be induced other than the preferred cable/sheave system described above. One such means involves the placement of springs within each longitudinal panel joint. Small compression coil or leaf springs can be placed with the panel joint such that they press out against the edges of adjoining panels until adequate joint rotation has occurred insuring smooth transition of the particular diversion roller into the channel of the diagonal guide rail. Reversed motion would restore the spring induced joint rotational force.

I claim:

1. A vertically collapsing closure system for garages and the like comprising a door including a plurality of substantially rectangular panels in side-by-side articulated relationship, and means for operating said door to a full open position by causing said panels to rise until at the height of the door opening and then to fold in succession into stacked relationship substantially above the door opening, said means operating in a reverse mode for returning said panels to full closing relationship with the door opening by successively unfolding the panels to vertical positions at the top of said door opening and causing them to descend to a full closing position relative to the door opening, said means includes panel mounted roller assemblies and a vertical rail section on opposite sides of the door opening, and a door counterweight means including a vertically movable counterweight, said counterweight comprising plural partial counterweights resting on drag means connected to said door, and each partial counterweight being associated with a stop means for retaining the partial counterweight in its descent at a predetermined elevation and thereby separating it from the drag means, at least several partial counterweights are further sub-divided into two movable parts mounted one above the other and displaceable vertically relative to each other, and a support for the upper part of each sub-divided partial counterweight and being displaceable vertically by a limited amount when the counterweight means is in its lowest position.

2. A vertically collapsing closure system as defined in claim 1, wherein said partial counterweights are mounted one above the other and cooperate with fixed stop means, and said movable parts are mounted one above the other and are displaceable vertically relative to each other, and said support for the upper part of each sub-divided partial counterweight being connected to a lifting system and being displaceable with said upper part a limited distance relative to the lower part of the sub-divided partial counterweight.

3. A vertically collapsing closure system as defined in claim 2, and said supports for said upper parts comprising plates disposed between said upper and lower parts, said plates having central openings for the free passage of a lifting cable, a lifting plate located above the lower part of the uppermost partial counterweight and being supported during counterweight descent and final ascent by the uppermost partial counterweight, said lifting plate being interconnected to said support plates by support rod links, and said support rod links being so spaced in relation to adjacent support plates as to avoid interference with complete vertical collapse of said partial counterweights.

4. A vertically collapsing closure system as defined in claim 3, wherein the effective lengths of said rod links are less than the separation distance between the fixed stop means for said partial counterweights, and said rod links causing earlier arrest of the upper parts.

5. A vertically collapsing closure system for garages and the like comprising a door including a plurality of substantially rectangular panels in side-by-side articulated relationship, and means for operating said door to a full open position by causing said panels to rise until at the height of the door opening and then to fold in succession into stacked relationship substantially above the door opening, said means operating in a reverse mode for returning said panels to full closing relationship with the door opening by successively unfolding the panels to vertical positions at the top of said door opening and causing them to descend to a full closing position relative to the door opening, said means includes panel mounted roller assemblies and a vertical rail section on opposite sides of the door opening, and a door counterweight means including a vertically movable counterweight, said counterweight comprising plural partial counterweights resting on drag means connected to said door, and each partial counterweight being associated with a stop means for retaining the partial counterweight in its descent at a predetermined elevation and thereby separating it from the drag means, said vertical rail section having a top laterally spaced parallel branch connected with the vertical rail section by an inclined diverter rail section, said panel mounted roller assemblies comprising single radius rollers carried by first shafts near corresponding edges of the panels and coaxial single and dual radius rollers carried by second shafts near the other corresponding edges of the panels, and cam means near the junctions of the inclined diverter rail section with said vertical rail section and engaging each dual radius roller to divert the adjacent coaxial single radius roller onto the diverter rail section while each single radius roller of each first shaft continues to rise toward the top of the vertical rail section to produce stacking of said panels above said door opening.

6. A vertically collapsing closure system as defined in claim 5, and another cam means on said vertical rail section engageable with the dual radius roller to induce lateral motion in the coaxial single radius roller at its lowest elevation to contribute to weather sealing of said door with a door jamb.

7. A vertically collapsing closure system as defined in claim 6, and said another cam means comprising plural longitudinally spaced cams on each vertical rail section below the intersection thereof with said inclined diverter rail section.

8. A vertically collapsing closure system as defined in claim 5, and the spacing of said vertical rail sections from each side edge of said door being equal and the vertical rail sections being mounted on adjacent door jamb sections in such a way that the channel-to-channel center line spacing of said rail sections equals the single radius roller center line spacing on said door panels.

9. A vertically collapsing closure system as defined in claim 5, and said cam means comprises a deflector cam at the intersection of the inclined diverter rail section and the vertical rail section, and an interceptor plate above the deflector cam on said inclined diverter rail section.

10. A vertically collapsing closure system as defined in claim 5, and said first shafts carrying said single radius rollers being located at the lower edges of said panels and said second shafts carrying the coaxial single and dual axis rollers being located at the upper edges of said panels except that the uppermost panel has the second shaft carrying the coaxial single and dual radius rollers at its lower edge.

11. A vertically collapsing closure system as defined in claim 5, and latching means to secure said door in the fully raised and fully lowered position in relation to the door opening.

12. A vertically collapsing closure system as defined in claim 11, and a common cable operator means for said latching means enabling release of the door for opening or closing depending upon the position of the door.

13. A vertically collapsing closure system as defined in claim 5, wherein the inclined diverter rail section is disposed substantially at 45 degrees of inclination to said vertical rail section in upwardly diverging relationship thereto, said diverter rail section extending upwardly from its intersection with the vertical rail section toward a point of intersection with the laterally spaced parallel branch and being joined thereto by a circularly curved section whose radius is approximately equal to the distance between the axes of said first shafts of adjacent panels.

14. A vertically collapsing closure system as defined in claim 13, and said diverter rail section at its lower end being joined to the vertical rail section by another circularly curved rail section having a somewhat smaller radius than the first-named circularly curved section.

15. A vertically collapsing closure system for garages and the like comprising a door including a plurality of substantially rectangular panels in side-by-side articulated relationship, and means for operating said door to a fully open position by causing said panels to rise until at the height of the door opening and then to fold in succession in stacked relationship substantially above the door opening, said means comprising guide rollers carried by opposite ends of said panels, at least alternate guide rollers having outer axle extensions, vertical rail sections near opposite sides of the door opening, inclined diverter rail sections leading from the vertical rail sections near the top of the door opening, and upper branch rail sections rising from said diverter rail sections, and the upper branch rail sections, inclined diverter rail sections and the portions of said vertical rail sections below the diverter rail sections being provided with interior secondary guide channels for said axle extensions to divert them smoothly from the vertical rail sections into the diverter rail sections, said rail sections also including main channels for the guidance of said guide rollers.

16. A vertically collapsing closure system as defined in claim 15, and said interior secondary guide channels being continuous and being formed in the outer side walls of members forming said main channels.

* * * * *